US009617670B2

(12) United States Patent
Katano et al.

(10) Patent No.: US 9,617,670 B2
(45) Date of Patent: Apr. 11, 2017

(54) SEWING MACHINE AND NON-TRANSITORY COMPUTER-READABLE MEDIUM

(71) Applicant: BROTHER KOGYO KABUSHIKI KAISHA, Nagoya-shi, Aichi-ken (JP)

(72) Inventors: Tomotaka Katano, Nagoya (JP); Chiyo Koga, Nagoya (JP); Kiyomi Kato, Ama (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 152 days.

(21) Appl. No.: 14/456,633

(22) Filed: Aug. 11, 2014

(65) Prior Publication Data

US 2015/0059631 A1 Mar. 5, 2015

(30) Foreign Application Priority Data

Aug. 29, 2013 (JP) ..... 2013-178525

(51) Int. Cl.
*D05B 19/16* (2006.01)
*D05B 19/12* (2006.01)

(52) U.S. Cl.
CPC ..... *D05B 19/16* (2013.01); *D05B 19/12* (2013.01)

(58) Field of Classification Search
CPC ... D05B 9/16; D05B 9/08; D05B 9/10; D05B 3/24; D05B 3/243; D05B 39/00; D05B 39/005
USPC ..... 112/102.5, 103.119, 470.06, 470.09, 112/470.14
See application file for complete search history.

(56) References Cited

U.S. PATENT DOCUMENTS 5,101,746 A * 4/1992 Frye ..... D05B 39/00 112/114
5,191,536 A * 3/1993 Komuro ..... D05B 19/08 112/102.5

(Continued)

FOREIGN PATENT DOCUMENTS

JP A-57-12156 1/1982
JP A-2002-52283 2/2002

(Continued)

*Primary Examiner* — Khoa Huynh
*Assistant Examiner* — Megan Brandon
(74) *Attorney, Agent, or Firm* — Oliff PLC

(57) ABSTRACT

A sewing machine includes a sewing portion, a switching frame, a movement mechanism, a processor, and a memory. The sewing portion is configured to perform sewing on a sewing workpiece. The switching frame is configured to hold the sewing workpiece. The movement mechanism is configured to move the switching frame mounted thereon. The memory is configured to store computer-readable instructions, wherein the computer-readable instructions, when executed by the processor, cause the sewing machine to perform processes that include acquiring first pattern data used to sew a first pattern, acquiring second pattern data used to sew a second pattern, causing the movement mechanism to move the switching frame and the sewing portion to sew the first pattern, causing the movement mechanism to move the switching frame to an escape position, and causing the movement mechanism to move the switching frame and the sewing portion to sew the second pattern.

7 Claims, 15 Drawing Sheets

(56) References Cited

U.S. PATENT DOCUMENTS 5,291,843 A * 3/1994 Hori ..... D05B 3/243 112/103
5,867,391 A * 2/1999 Muto ..... D05B 19/08 112/103
5,899,155 A * 5/1999 Thoren ..... D05C 9/04 112/103
6,237,516 B1 * 5/2001 Wakayama ..... D05B 19/105 112/102.5
7,836,837 B2 * 11/2010 Torii ..... D05B 19/08 112/102.5
8,438,984 B2 * 5/2013 Hasegawa ..... D05C 9/04 112/103
2005/0072346 A1 * 4/2005 Shoji ..... D05C 9/04 112/103
2006/0167581 A1 * 7/2006 Kawaguchi ..... D05B 19/10 700/138
2007/0079741 A1 * 4/2007 Watanabe ..... D05C 9/04 112/103
2007/0227420 A1 * 10/2007 Suzuki ..... D05B 19/08 112/2
2007/0277715 A1 * 12/2007 Watanabe ..... D05B 39/00 112/103
2008/0098940 A1 * 5/2008 Kuki ..... D05B 39/00 112/103
2009/0025621 A1 * 1/2009 Matsuzawa ..... D05B 19/10 112/102.5
2009/0107374 A1 * 4/2009 Ukai ..... D05B 3/04 112/470.06
2009/0188413 A1 * 7/2009 Hirata ..... D05B 19/10 112/103
2009/0188414 A1 * 7/2009 Tokura ..... D05B 19/10 112/457
2009/0205549 A1 * 8/2009 Hirose ..... D05B 19/16 112/470.04
2009/0217850 A1 * 9/2009 Tokura ..... D05B 19/16 112/102.5
2010/0206204 A1 * 8/2010 Shimizu ..... D05B 39/00 112/102.5
2011/0056420 A1 * 3/2011 Kawaguchi ..... D05C 9/04 112/103
2011/0094424 A1 * 4/2011 Tokura ..... D05B 19/10 112/102.5
2011/0295410 A1 * 12/2011 Yamada ..... D05B 19/08 700/138
2012/0048162 A1 * 3/2012 Tokura ..... D05C 5/06 112/102.5
2012/0222602 A1 * 9/2012 Hishida ..... D05B 23/00 112/470.05
2013/0074749 A1 * 3/2013 Kato ..... D05B 19/02 112/102.5
2013/0133561 A1 * 5/2013 Ikeba ..... D05B 19/10 112/102.5
2013/0186316 A1 * 7/2013 Mizuno ..... D05B 19/08 112/102.5
2013/0199430 A1 * 8/2013 Kato ..... D05B 81/00 112/470.05
2013/0239858 A1 * 9/2013 Ihira ..... D05C 5/06 112/102.5
2013/0243262 A1 * 9/2013 Yamada ..... D05B 19/08 382/111
2013/0298811 A1 * 11/2013 Prufer ..... D05B 37/04 112/2

FOREIGN PATENT DOCUMENTS

JP A-2003-53069 2/2003
JP A-2003-53071 2/2003
JP A-2003-53072 2/2003
JP A-2011-55887 3/2011

* cited by examiner

SEWING MACHINE AND NON-TRANSITORY COMPUTER-READABLE MEDIUM

CROSS-REFERENCE TO RELATED APPLICATION

This application claims priority to Japanese Patent Application No. 2013-178525 filed Aug. 29, 2013, the content of which is hereby incorporated herein by reference.

BACKGROUND

The present disclosure relates to a sewing machine and a non-transitory computer-readable medium that are capable of performing embroidery sewing on a sewing workpiece.

A sewing machine is known that performs embroidery sewing based on embroidery data specifying coordinates of needle drop points, while moving a sewing needle and a sewing workpiece held by an embroidery frame in relation to each other. Further, a sewing machine is known that is able to sew a pattern to be formed of normal stitches, which run along a surface of the sewing workpiece, and loop-shaped stitches, which protrude from the surface. In this sewing machine, it is possible to turn the embroidery frame upside down and then attach the embroidery frame to the sewing machine.

SUMMARY

The above-described known sewing machine forms the normal stitches on a top surface of the sewing workpiece and forms the loop shaped stitches on a bottom surface of the sewing workpiece. Thus, in order to form the normal stitches and the loop shaped stitches on the same surface of the sewing workpiece, after one of the normal stitches and the loop shaped stitches are formed, it is necessary to turn the embroidery frame that holds the sewing workpiece upside down. In this case, it is necessary for the user to remove the embroidery frame from the sewing machine, to turn the embroidery frame upside down, and to once more attach the embroidery frame to the sewing machine. Such a user operation may therefore be complicated.

Embodiments of the broad principles derived herein provide a sewing machine that allows a user to easily switch a posture of a holding portion of an embroidery frame that holds a sewing workpiece, and a non-transitory computer-readable medium.

Embodiments provide a sewing machine that includes a sewing portion, a switching frame, a movement mechanism, a processor, and a memory. The sewing portion is configured to perform sewing on a sewing workpiece. The sewing portion includes a needle bar and a needle plate. The switching frame is configured to hold the sewing workpiece. The switching frame includes a holding portion, a base portion, and a switching portion. The holding portion is configured to hold the sewing workpiece. The base portion is configured to support the holding portion. The movement mechanism is configured to move the switching frame that is mounted thereon. The switching portion is configured to be capable of switching a posture of the holding portion between a first posture and a second posture in a state in which the base portion is mounted on the movement mechanism. The holding portion has a first surface and a second surface and is configured such that, in a state in which the holding portion is in the first posture, the first surface is arranged on a side of the needle bar and the second surface is arranged on a side of the needle plate. The second surface is on a side opposite to the first surface of the holding portion. The holding portion is configured such that, in a state in which the holding portion is in the second posture, the second surface is arranged on the side of the needle bar and the first surface is arranged on the side of the needle plate. The memory is configured to store computer-readable instructions, wherein the computer-readable instructions, when executed by the processor, cause the sewing machine to perform processes that include acquiring first pattern data used to sew a first pattern, the first pattern being a pattern to be sewn in the state in which the holding portion is in the first posture, acquiring second pattern data used to sew a second pattern, the second pattern being a pattern to be sewn after the first pattern is sewn, causing the movement mechanism to move the switching frame and causing the sewing portion to sew the first pattern on the sewing workpiece, based on the acquired first pattern data, causing the movement mechanism to move the switching frame to an escape position after the first pattern is sewn, the escape position being a position in which the posture of the holding portion is switchable from the first posture to the second posture, and causing the movement mechanism to move the switching frame and causing the sewing portion to sew the second pattern on the sewing workpiece, based on the acquired second pattern data, after the movement mechanism moves the switching frame to the escape position.

Embodiments also provide a non-transitory computer-readable medium storing computer-readable instructions that, when executed by a processor of a sewing machine, cause the sewing machine to perform processes that include acquiring first pattern data used to sew a first pattern, the first pattern being a pattern to be sewn in a state in which a holding portion of a switching frame of the sewing machine is in a first posture, the switching frame being configured to hold a sewing workpiece, the switching frame including the holding portion, a base portion, and a switching portion, the holding portion being configured to hold the sewing workpiece, the base portion being configured to support the holding portion, the switching portion being configured to be capable of switching a posture of the holding portion between the first posture and a second posture in a state in which the base portion is mounted on a movement mechanism of the sewing machine, the movement mechanism being configured to move the switching frame that is mounted thereon, the holding portion having a first surface and a second surface and being configured such that, in the state in which the holding portion is in the first posture, the first surface is arranged on a side of a needle bar of a sewing portion of the sewing machine and the second surface is arranged on a side of a needle plate of the sewing portion, the sewing portion being configured to perform sewing on the sewing workpiece, the second surface being on a side opposite to the first surface of the holding portion, and the holding portion being configured such that, in a state in which the holding portion is in the second posture, the second surface is arranged on the side of the needle bar and the first surface is arranged on the side of the needle plate, acquiring second pattern data used to sew a second pattern, the second pattern being a pattern to be sewn after the first pattern is sewn, causing the movement mechanism to move the switching frame and causing the sewing portion to sew the first pattern on the sewing workpiece, based on the acquired first pattern data, causing the movement mechanism to move the switching frame to an escape position after the first pattern is sewn, the escape position being a position in which the posture of the holding portion is switchable from the first posture to the second posture, and causing the movement mechanism to move the switching frame and causing the sewing portion to sew the second pattern on the sewing workpiece, based on the acquired second pattern data, after the movement mechanism moves the switching frame to the escape position.

BRIEF DESCRIPTION OF THE DRAWINGS

Embodiments will be described below in detail with reference to the accompanying drawings in which.

DETAILED DESCRIPTION

Figure 1:
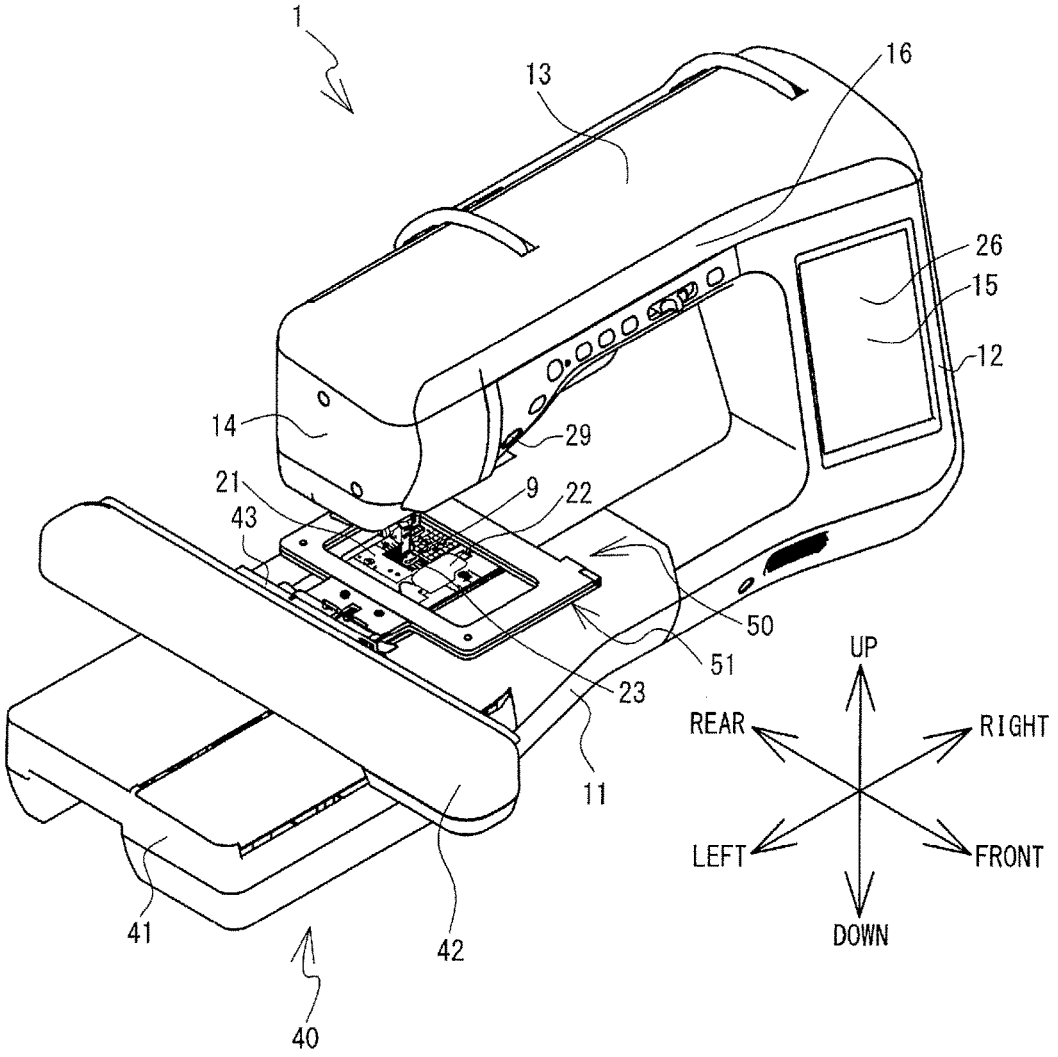
FIG. 1 is a perspective view of a sewing machine illustrating a state in which an embroidery frame has been moved to a sewing position.

Hereinafter, a first embodiment and a second embodiment will be explained with reference to the drawings. A physical configuration of a sewing machine 1 will be explained with reference to FIGS. 1 to 3. The up-down direction, the lower right, the upper left, the lower left, and the upper right of FIGS. 1 and 2 respectively correspond to the up-down direction, the front, the rear, the left, and the right of the sewing machine 1. In other words, a surface on which a liquid crystal display 15 (that will be explained below) is disposed is a front surface of the sewing machine 1. A lengthwise direction of a bed 11 and an arm 13 is the left-right direction of the sewing machine 1, and a side on which a pillar 12 is disposed is the right side of the sewing machine 1. A direction in which the pillar 12 extends is the up-down direction of the sewing machine 1. In the first embodiment and the second embodiment, the physical configuration and an electrical configuration of the sewing machine 1 are the same.

Figure 2:
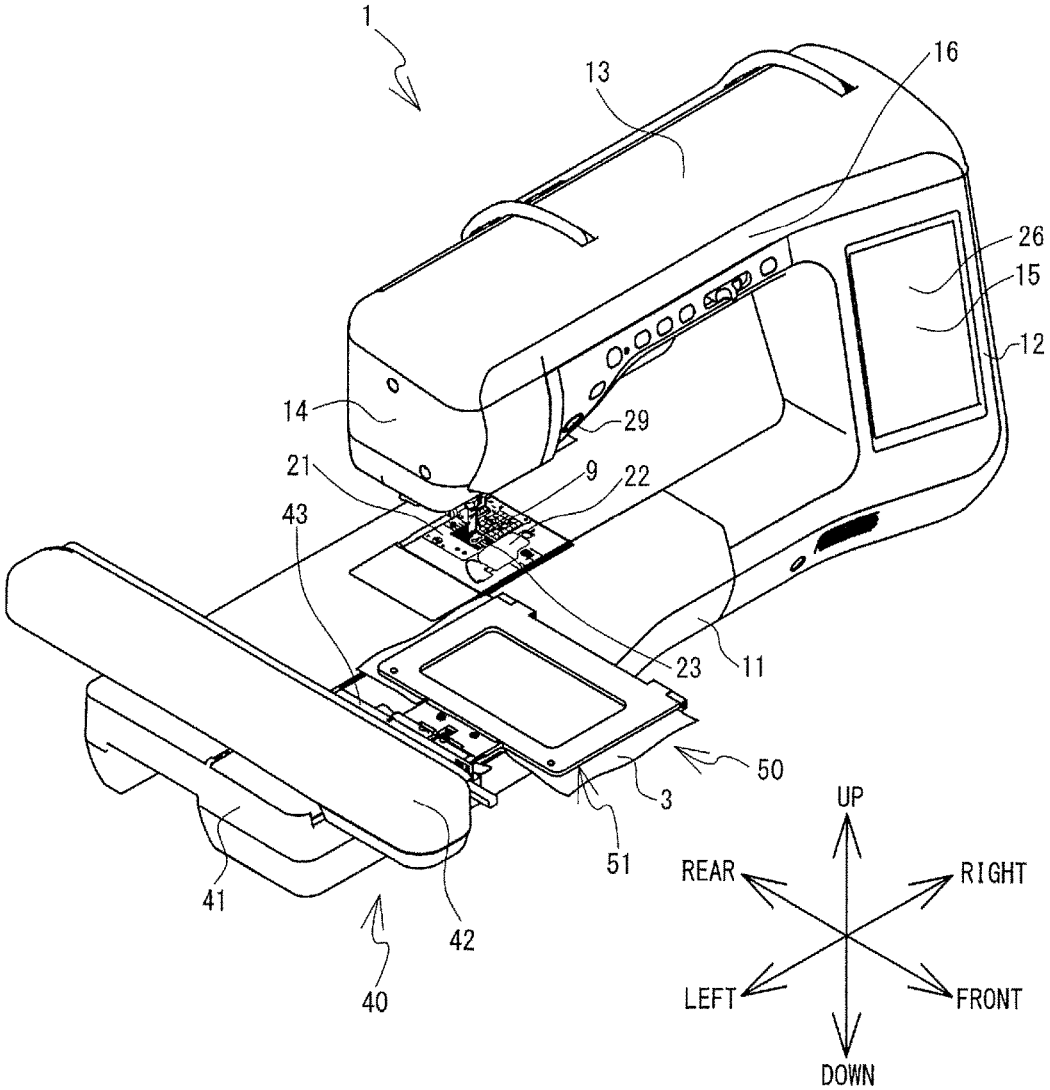
FIG. 2 is a perspective view of the sewing machine in a state in which the embroidery frame has been moved to an escape position.

As shown in FIGS. 1 and 2, the sewing machine 1 includes the bed 11, the pillar 12, the arm 13, and a head 14. The bed 11 is a base portion of the sewing machine 1 and extends in the left-right direction. The pillar 12 extends upward from the right end portion of the bed 11. The arm 13 extends to the left from the upper end portion of the pillar 12, facing the bed 11. The head 14 is a portion that is connected to the left leading end portion of the arm 13.

A needle plate 21 is provided on the top surface of the bed 11. The needle plate 21 has a needle hole (not shown in the drawings). The sewing machine 1 includes a feed dog 23, a feed mechanism (not shown in the drawings), a shuttle mechanism, and the like underneath the needle plate 21 (namely, inside the bed 11). When normal sewing, which is not embroidery sewing, is performed, the feed dog 23 is driven by the feed mechanism to feed a sewing workpiece (such as a work cloth) by a predetermined feed amount. The shuttle mechanism may cause an upper thread (not shown in the drawings) to be entwined with a lower thread (not shown in the drawings), underneath the needle plate 21. Although not shown in the drawings, the shuttle mechanism includes a known horizontal shuttle that has an outer shuttle and an inner shuttle. The outer shuttle may be rotationally driven in synchronization with the rotation of a drive shaft (not shown in the drawings). The inner shuttle may be removably provided inside the outer shuttle, and is unable to rotate. A lower thread bobbin (not shown in the drawings), on which the lower thread is wound, may be removably mounted in the interior of the inner shuttle. The needle plate 21 is provided with a needle plate cover 22, which is a lid member that can cover the upper side of the shuttle (the horizontal shuttle), which houses the lower thread, and that can open and close. A user may remove the needle plate cover 22 from the needle plate 21 and may replace the inner shuttle and the lower thread bobbin. As will be explained in more detail below, a separate inner shuttle, which is specifically used for a bobbin work pattern, is prepared for the sewing machine 1.

The sewing machine 1 further includes an embroidery frame movement mechanism (hereinafter referred to as a "movement mechanism") 40. The movement mechanism 40 can be mounted on and removed from the bed 11 of the sewing machine 1. FIGS. 1 and 2 show a state in which the movement mechanism 40 is mounted on the sewing machine 1. In a case where the movement mechanism 40 is mounted on the sewing machine 1, the movement mechanism 40 and the sewing machine 1 are electrically connected. The movement mechanism 40 includes a main body portion 41 and a carriage 42. The carriage 42 is provided above the main body portion 41. The carriage 42 has a substantially rectangular parallelepiped shape that is long in the front-rear direction. The carriage 42 includes a frame holder 43, a Y axis movement mechanism (not shown in the drawings), and a Y axis motor 84. The frame holder 43 is provided on the right side surface of the carriage 42. One of a plurality of types of embroidery frames can be mounted on or removed from the frame holder 43. In a state in which the embroidery frame 50 is attached to the carriage 42, the embroidery frame 50 is a switching frame that is configured such that a holding portion 51 of the embroidery frame 50 can change its vertical orientation. The embroidery frame 50 will be explained in more detail below. In addition to the embroidery frame 50, the sewing machine 1 is provided with an embroidery frame (not shown in the drawings) having a known structure that holds the sewing workpiece using an inner frame and an outer frame, and the embroidery frame may be mounted on the sewing machine 1 in place of the embroidery frame 50. A known detector 36 (refer to FIG. 11), which may detect the type of the embroidery frame attached to the carriage 42, is provided on the carriage 42. For example, Japanese Laid-Open Patent Publication No. 2002-52283 discloses a detector, the relevant portions of which are incorporated by reference. In a case where the embroidery frame 50 has been moved to a sewing position illustrated in FIG. 1, a sewing workpiece 3 (refer to FIG. 2) that is held by the embroidery frame 50 is disposed above the needle plate 21 and below a needle bar 6 and a presser foot 9, which will be explained below. The Y axis movement mechanism moves the frame holder 43 in the front-rear direction (a Y axis direction). By the frame holder 43 being moved in the front-rear direction, the embroidery frame 50 may move the sewing workpiece 3 in the front-rear direction. The Y axis motor 84 drives the Y axis movement mechanism.

The main body portion 41 internally includes an X axis movement mechanism, which is not shown in the drawings, and an X axis motor 83. The X axis movement mechanism moves the carriage 42 in the left-right direction (an X axis direction). By the carriage 42 being moved in the left-right direction, the embroidery frame 50 may move the sewing workpiece 3 in the left-right direction. The X axis motor 83 drives the X axis movement mechanism. The movement mechanism 40 may move the embroidery frame mounted on the carriage 42 to a position indicated by a unique XY coordinate system (an embroidery coordinate system).

The liquid crystal display (hereinafter referred to as the LCD) 15 is provided on the front surface of the pillar 12. An image including various items, such as a command, an illustration, a setting value, a message, etc., may be displayed on the LCD 15. A touch panel 26, which can detect a pressed position, is provided on the front surface side of the LCD 15. When the user performs a pressing operation on the touch panel 26 using a finger or a stylus pen (not shown in the drawings), the pressed position may be detected by the touch panel 26. A CPU 61 (refer to FIG. 11) of the sewing machine 1 may recognize an item selected on the image, based on the detected pressed position. Hereinafter, the pressing operation on the touch panel 26 by the user is referred to as a panel operation. By a panel operation, the user may select a pattern that the user desires to sew, or may select a command to be executed etc. A sewing machine motor 81 (refer to FIG. 11) is provided inside the pillar 12.

A cover 16 is provided on an upper portion of the arm 13 such that the cover 16 can open and close. In FIGS. 1 and 2, the cover 16 is in a closed state. Although not shown in the drawings, a thread storage portion is provided below the cover 16, that is, inside the arm 13. The thread storage portion may house a thread spool (not shown in the drawings) on which the upper thread is wound. The drive shaft (not shown in the drawings), which extends in the left-right direction, is provided inside the arm 13. The drive shaft is rotationally driven by the sewing machine motor 81. Various switches, including a start/stop switch 29, are provided on the lower left portion of the front surface of the arm 13. The start/stop switch 29 is used to input an instruction to start or stop the operation of the sewing machine 1, namely, to start or stop sewing.

Figure 3:
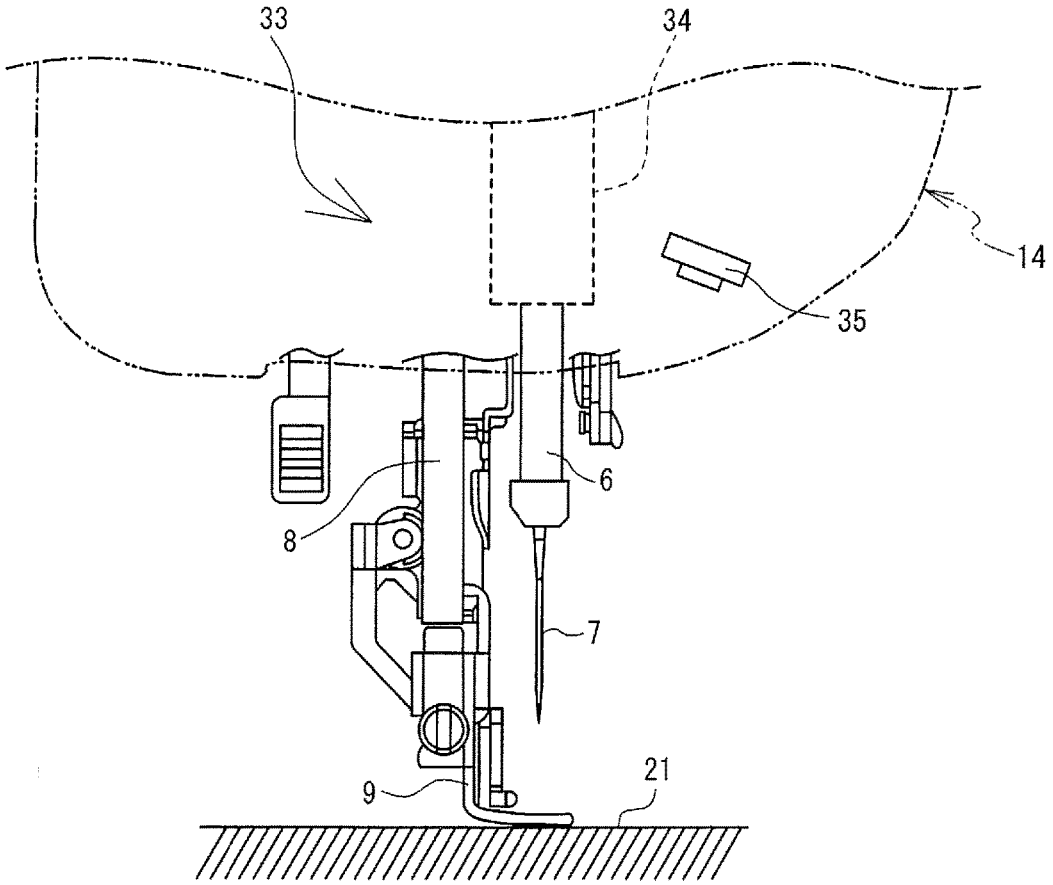
FIG. 3 is an explanatory diagram showing a configuration of a lower end portion of a head.

As shown in FIG. 3, the needle bar 6, a presser bar 8, a needle bar up-and-down movement mechanism 34, etc. are provided on the head 14. The needle bar 6 and the presser bar 8 extend downward from the lower end portion of the head 14. A sewing needle 7 may be removably attached to the lower end of the needle bar 6. The presser foot 9 may be removably attached to the lower end portion of the presser bar 8. The needle bar 6 is provided on the lower end of the needle bar up-and-down movement mechanism 34. The needle bar up-and-down movement mechanism 34 drives the needle bar 6 in the up-down direction as a result of the rotation of the drive shaft. The sewing machine 1 includes the needle bar 6, the needle plate 21, the needle bar up-and-down movement mechanism 34, and the sewing machine motor 81 (refer to FIG. 11) as a sewing portion 33.

An image sensor 35 is provided inside the head 14. The image sensor 35 is, for example, a known complementary metal oxide semiconductor (CMOS) image sensor. The image sensor 35 captures an image of a predetermined capture area and outputs image data of the captured image. The output image data is stored in a predetermined storage area of a RAM 63 (refer to FIG. 11). In a case where the embroidery frame 50 is arranged in an initial position, the image sensor 35 of the present embodiment can capture a rectangular area that is larger than a sewing area (that will be explained below). As the image capture is not performed in pattern sewing processing (that will be explained below) of the first embodiment, the sewing machine 1 of the first embodiment need not necessarily be provided with the image sensor 35.

Operations of the sewing machine 1 will be briefly explained. At the time of embroidery sewing, the embroidery frame 50 is moved in the left-right direction (the X axis direction) and the front-rear direction (the Y axis direction) by the movement mechanism 40, and the needle bar up-and-down movement mechanism 34 and the shuttle mechanism (not shown in the drawings) are driven. In this way, an embroidery pattern may be sewn on the sewing workpiece 3, which is held by the embroidery frame 50, by the sewing needle 7 attached to the needle bar 6. In a case where a normal utility pattern, which is not an embroidery pattern, is sewn, the sewing may be performed while the sewing workpiece 3 is moved by the feed dog 23, in a state in which the movement mechanism 40 is removed from the bed 11.

Figure 4:
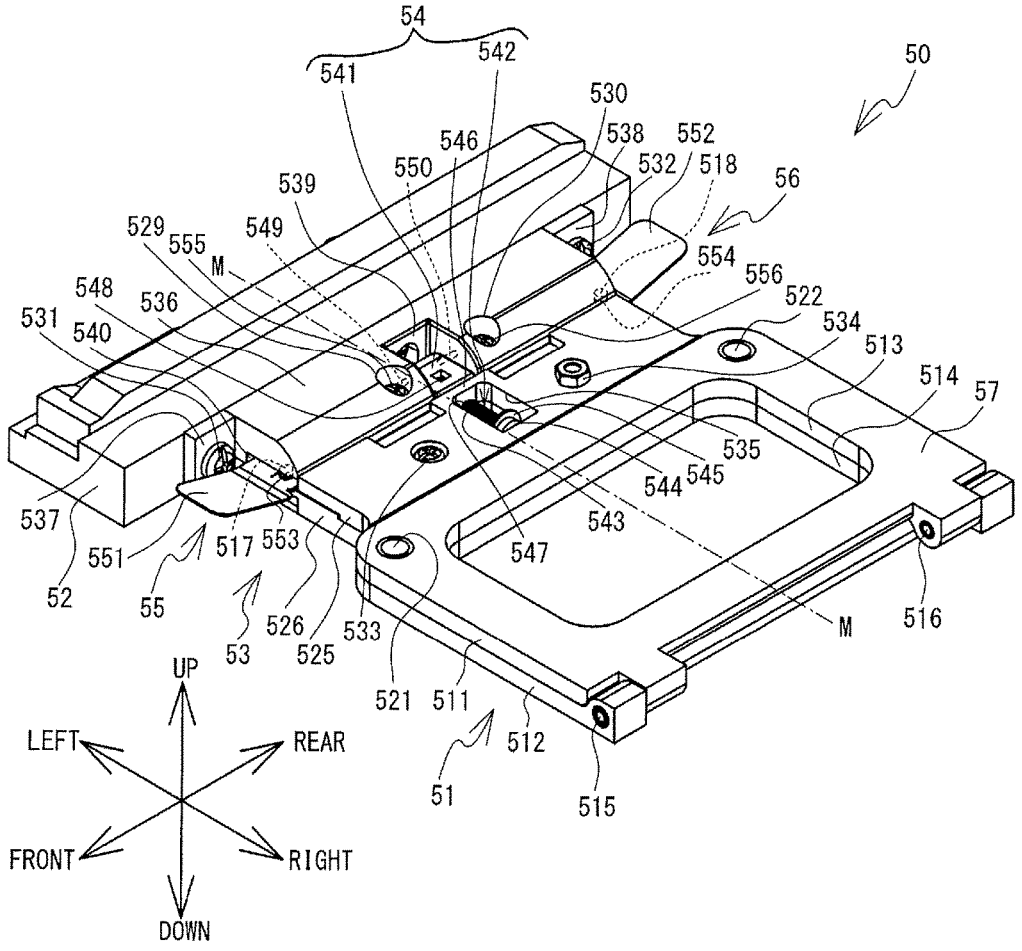
FIG. 4 is a perspective view of the embroidery frame in a first posture, in a closed state in which a holding portion is closed.
Figure 5:
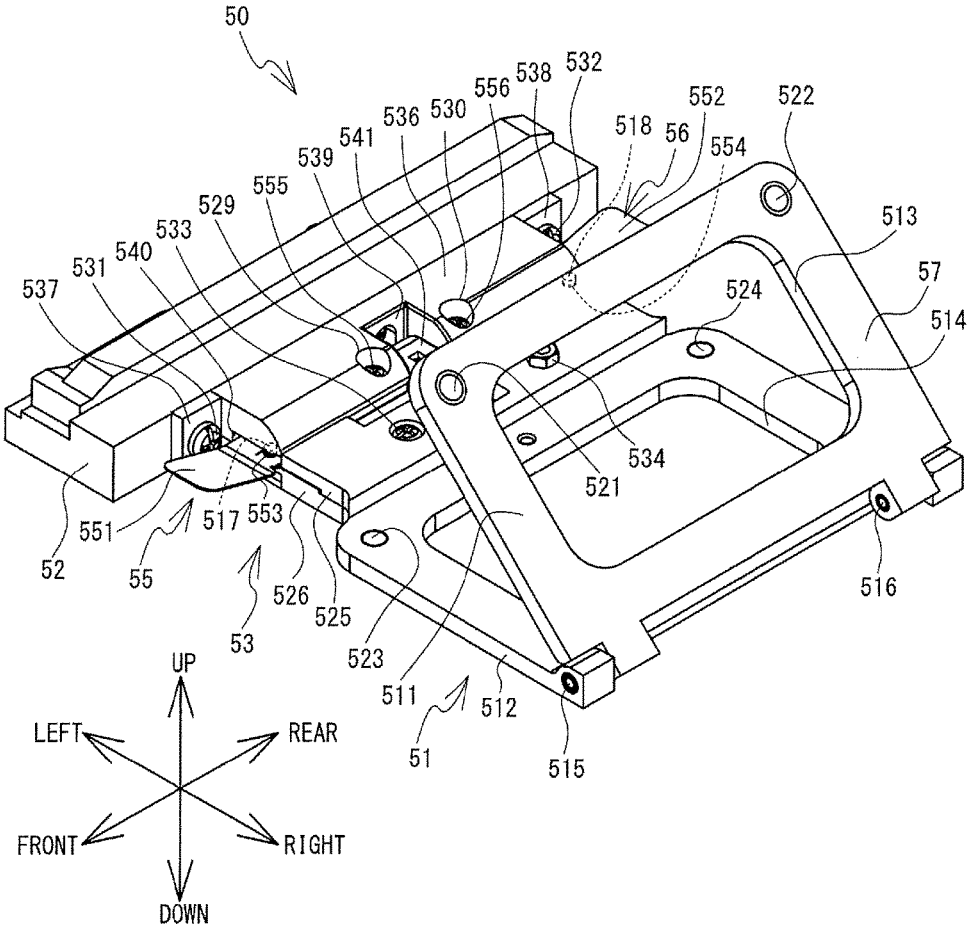
FIG. 5 is a perspective view of the embroidery frame in the first posture, in an open state in which the holding portion is open.
Figure 6:
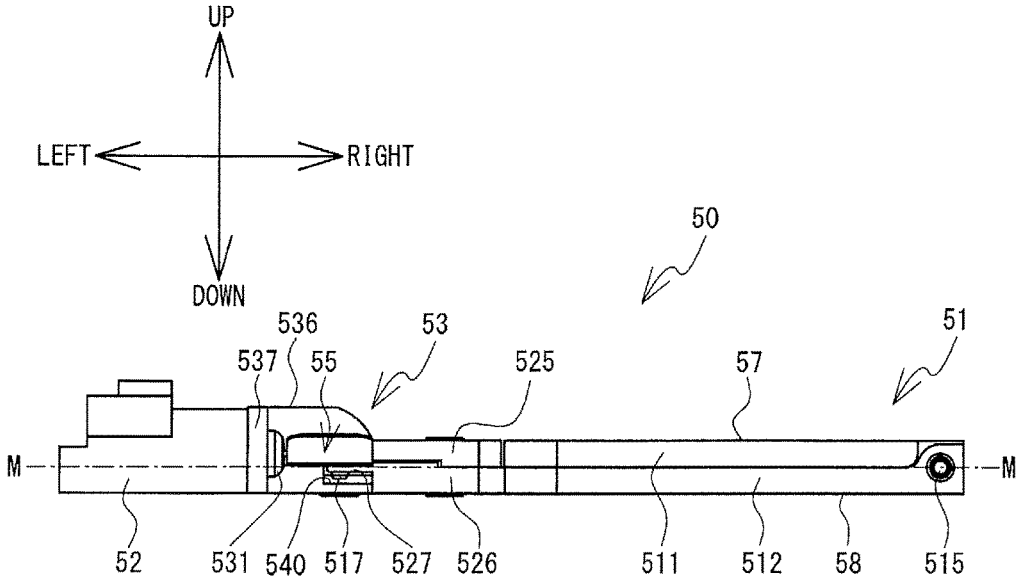
FIG. 6 is a front view of the embroidery frame in the first posture, in the closed state in which the holding portion is closed.

The structure of the embroidery frame 50 will be explained with reference to FIGS. 4 to 10. As shown in FIG. 4, the embroidery frame 50 mainly includes the holding portion 51, a base portion 52, and a switching portion 53. The holding portion 51 may hold the sewing workpiece 3 (refer to FIG. 2). In a case where a virtual line that passes through a central position of the holding portion 51 in the front-rear direction and the up-down direction is designated as a central line M, a shape of the holding portion 51 is symmetrical with respect to a vertical plane that includes the central line M. As shown in FIGS. 4 to 8, the holding portion 51 mainly includes a first member 511, a second member 512, pivot portions 515 and 516, magnets 521 to 524, connecting plate portions 525 and 526, and insertion plate portions 527 and 528. The second member 512 may clamp the sewing workpiece 3 along with the first member 511. The first member 511 has a first surface 57. The second member 512 has a second surface 58. The second surface 58 is a surface on the opposite side to the first surface 57 in the holding portion 51. The first member 511 and the second member 512 have frame shapes having holes 513 and 514, which are substantially rectangular in a plan view, respectively. The pivot portions 515 and 516 are respectively provided on the right end portions of the first member 511 and the second member 512, and pivotally support the first member 511 and the second member 512 such that the first member 511 and the second member 512 can open and close. FIGS. 4 and 6 show a closed state, which is a state in which the first member 511 is closed with respect to the second member 512. The first member 511 and the second member 512 have the same thickness as each other. Thus, the sewing workpiece 3 that is clamped between the first member 511 and the second member 512 may be arranged on a horizontal plane that includes the central line M. In the closed state, the first member 511 and the second member 512 may hold the sewing workpiece 3 in the up-down direction. The embroidery sewing is performed when the holding portion 51 is in the closed state. FIG. 5 shows an open state, which is a state in which the first member 511 is open with respect to the second member 512. When causing the new sewing workpiece 3 to be held by the holding portion 51 or when removing the sewing workpiece 3 from the holding portion 51, the user may cause the holding portion 51 to be in the open state.

Figure 7:
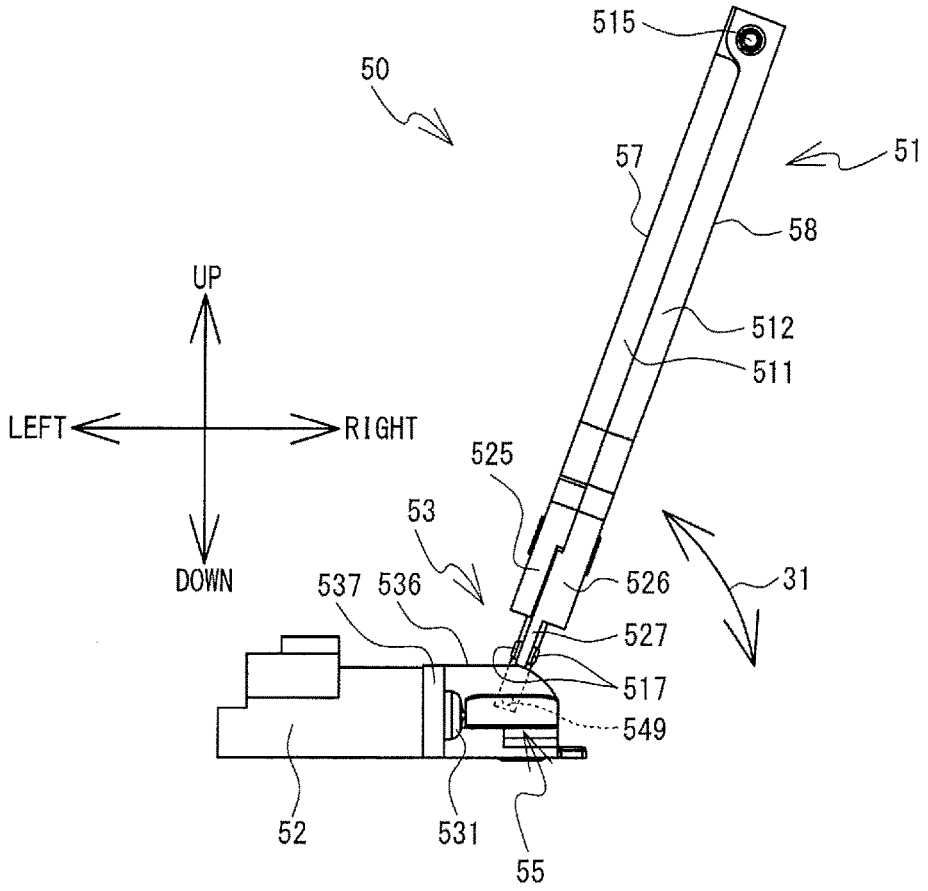
FIG. 7 is a front view of the embroidery frame in a process of being changed from the first posture to a second posture.
Figure 8:
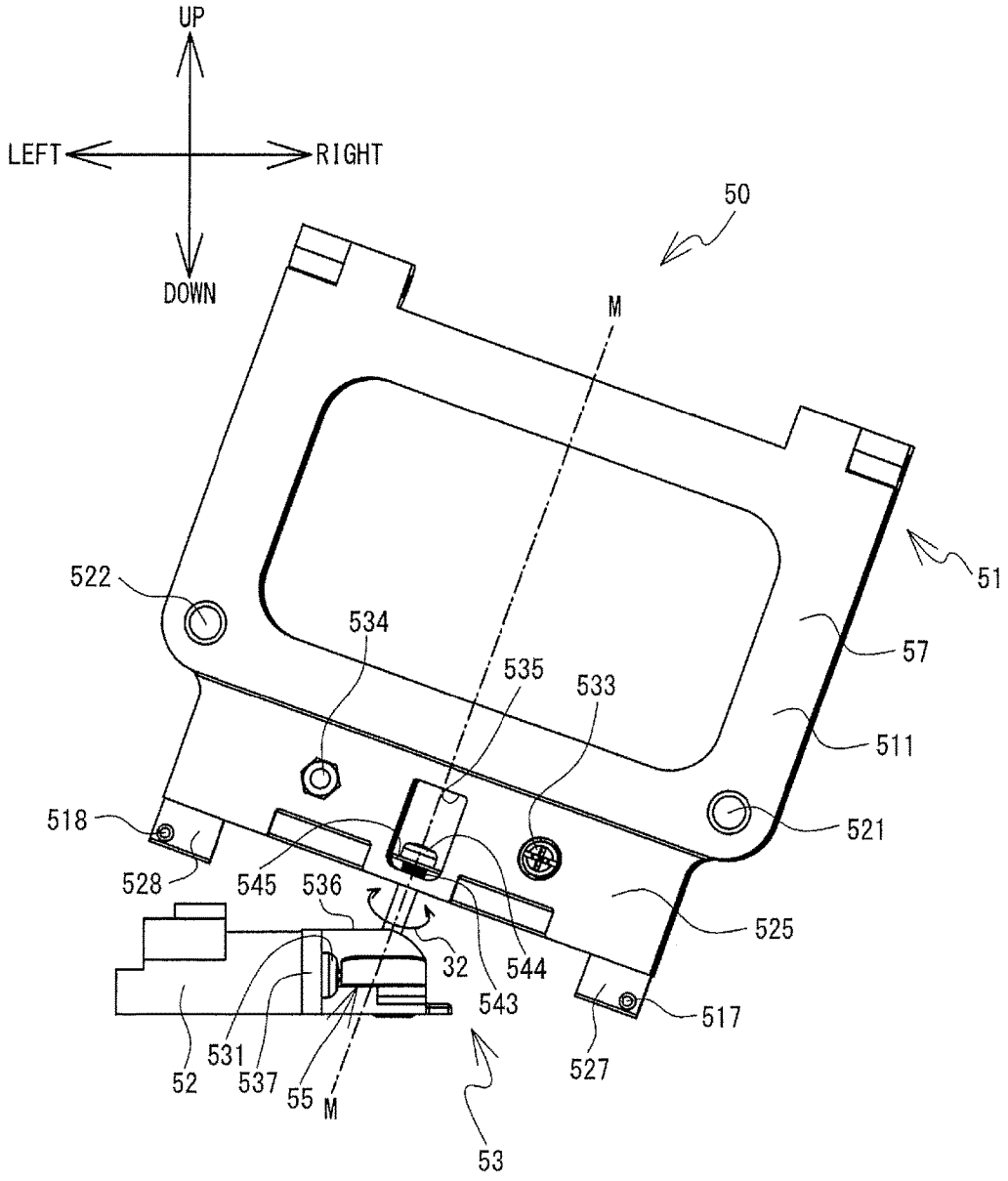
FIG. 8 is a front view of the embroidery frame in the process of being changed from the first posture to the second posture.
Figure 9:
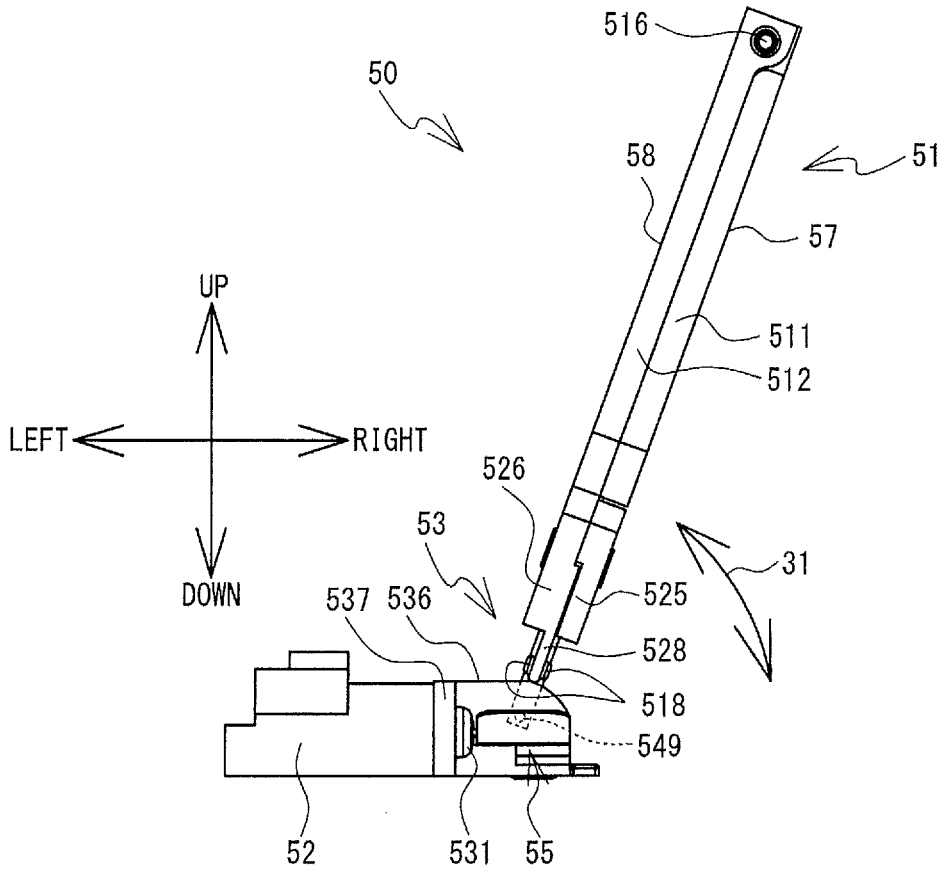
FIG. 9 is a front view of the embroidery frame in the process of being changed from the first posture to the second posture.

The magnets 521 and 522 are provided on a left portion of the first member 511. The magnets 523 and 524 are provided on a left portion of the second member 512, in positions opposite to the magnets 521 and 522, respectively. The magnets 521 to 524 exert a magnetic force (an attracting force) in the direction of closing of the first member 511 and the second member 512, namely, in the direction approaching the left portion of the first member 511 and the left portion of the second member 512. The connecting plate portions 525 and 526 are plate-shaped portions that each have a substantially rectangular shape in a plan view and extend in the front-rear direction. The connecting plate portion 526 is formed integrally with the second member 512. The connecting plate portion 525 is fixed to the top surface of the connecting plate portion 526 by fixing members 533 and 534. As shown in FIG. 4, a hole 535 is provided in a central portion in the front-rear direction of the connecting plate portions 525 and 526. The hole 535 has a substantially rectangular shape that is longer in the left-right direction in a plan view, and penetrates through the connecting plate portions 525 and 526 in the up-down direction. A hole 547 that penetrates in the left-right direction is provided in a left wall 546 of the hole 535. As shown in FIG. 8, the insertion plate portions 527 and 528 are plate-shaped portions that are substantially rectangular in a plan view, and are respectively connected to a front left portion and a left rear portion of the connecting plate portion 526. Engagement portions 517 are formed on both surfaces of the insertion plate portion 527. Engagement portions 518 are formed on both surfaces of the insertion plate portion 528. As shown in FIG. 7, the engagement portions 517 are convex portions that are symmetrical with respect to the insertion plate portion 527. As shown in FIG. 9, the engagement portions 518 are convex portions that are symmetrical with respect to the insertion plate portion 528.

The base portion 52 supports the holding portion 51. The base portion 52 may be removably mounted on the carriage 42 of the movement mechanism 40 of the sewing machine 1. The type of the embroidery frame 50 may be detected by the detector 36 based on a shape of the base portion 52.

The switching portion 53 can switch a posture of the holding portion 51 between a first posture and a second posture, in a state in which the base portion 52 is mounted on the carriage 42. The first posture is a posture in which the first surface 57 of the holding portion 51 is arranged on the side of the needle bar 6 of the sewing machine 1, and the second surface 58, which is on the opposite side to the first surface 57 of the holding portion 51, is arranged on the side of the needle plate 21 of the sewing machine 1. The second posture is a posture in which the second surface 58 is arranged on the side of the needle bar 6 and the first surface 57 is arranged on the side of the needle plate 21. In the present embodiment, the side of the needle bar 6 of the sewing machine 1 is the upper side and the side of the needle plate 21 of the sewing machine 1 is the lower side.

The switching portion 53 mainly includes a support portion 536, fixing portions 537 and 538, a connecting portion 54, and latching portions 55 and 56. The support portion 536 has a shape in which a recessed portion 539 and a pair of recessed portions 540, which are recessed toward the left, are provided in a right surface of a substantially rectangular parallelepiped that is long in the front-rear direction. The recessed portion 539 extends in the up-down direction, in the center of the front-rear direction in a right side view. The pair of recessed portions 540 are provided on both sides of the recessed portion 539 in a right side view and extends in the front-rear direction. The support portion 536 has holes 529 and 530, which extend in the up-down direction. The fixing portions 537 and 538 are connected to a front portion and a rear portion of the support portion 536, respectively. The fixing portions 537 and 538 are fixed to the base portion 52 by screws 531 and 532, respectively.

The connecting portion 54 rotatably connects the holding portion 51 to the base portion 52. The connecting portion 54 of the present embodiment mainly includes a first support portion 541 and a second support portion 542. The first support portion 541 is provided with shafts 549 and 550, which are provided in a front portion and a rear portion of the first support portion 541. The shafts 549 and 550 are supported by the support portion 536 such that the first support portion 541 can rotate in a first direction. The first direction of the present embodiment indicates the clockwise direction and the counterclockwise direction in a front view, in which the first support portion 541 rotates around the shafts 549 and 550, as indicated by arrows 31 in FIGS. 7 and 9. The first support portion 541 is provided with a nut 548. The nut 548 fixes the leading end of a bolt 544 as will be explained below. The first support portion 541 is connected to the holding portion 51 via the bolt 544. Thus, the first support portion 541 supports the holding portion 51 such that the holding portion 51 can rotate in the first direction with respect to the base portion 52.

The second support portion 542 supports the holding portion 51 such that the holding portion 51 can rotate in a second direction. The second direction is a direction that intersects the first direction. The second direction of the present embodiment indicates the direction in which the holding portion 51 rotates around a shaft axis of the bolt 544, as indicated by arrows 32 in FIG. 8. The shaft axis of the bolt 544 is aligned with the central line M that is described above. The second support portion 542 mainly includes a spring 543, the bolt 544, and a washer 545. The bolt 544 is inserted from the right side into a hole 547, in a state in which the bolt 544 is inserted through the spring 543 and the washer 545. The inner diameter of the hole 547 is slightly larger than the outer diameter of the bolt 544. The leading end of the bolt 544 is inserted through a hole (not shown in the drawings) that is provided in the right end portion of the first support portion 541, and is then fixed by the nut 548. The bolt 544 is supported by the first support portion 541.

The latching portions 55 and 56 can regulate the rotation of the holding portion 51 with respect to the base portion 52, when the holding portion 51 is in one of the first posture and the second posture. The latching portion 55 includes a plate spring 551. A rear portion of the plate spring 551 is inserted into the recessed portion 540 of the support portion 536. A front portion of the plate spring 551 is further to the front than the front end of the support portion 536. The rear portion of the plate spring 551 is fixed to the support portion 536 by a screw 555, which is inserted through the hole 529. The plate spring 551 has a hole 553, which penetrates in the up-down direction. In a similar manner, the latching portion 56 includes a plate spring 552. A front portion of the plate spring 552 is inserted into the recessed portion 540 of the support portion 536. The rear portion of the plate spring 552 is further to the rear than the rear end of the support portion 536. The front portion of the plate spring 552 is fixed to the support portion 536 by a screw 556, which is inserted through the hole 530. The plate spring 552 has a hole 554, which penetrates in the up-down direction. When the holding portion 51 is in one of the first posture and the second posture, the insertion plate portions 527 and 528 can be arranged below the plate springs 551 and 552. At that time, the engagement portions 517 and 518 engage with the hole 553 or the hole 554, depending on the posture of the holding portion 51. The insertion plate portions 527 and 528 are clamped by the spring plates 551 and 552 and the support portion 536, and thus the rotation of the holding portion 51 with respect to the base portion 52 is regulated.

Figure 10:
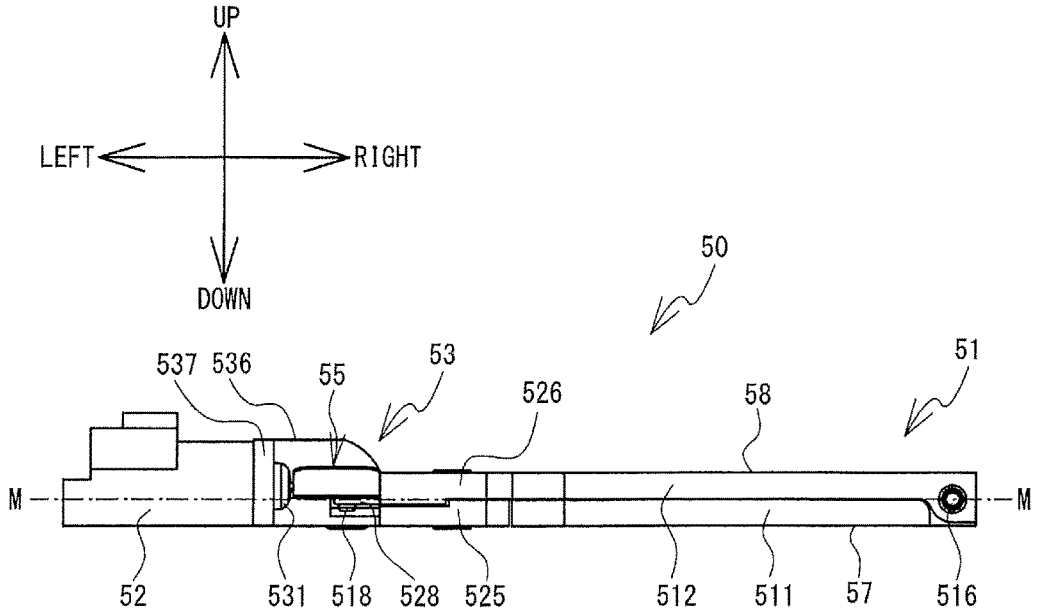
FIG. 10 is a front view of the embroidery frame in the second posture, in the closed state in which the holding portion is closed.

A method for changing the posture of the holding portion 51 of the embroidery frame 50 from the first posture shown in FIG. 6 to the second posture shown in FIG. 10 will be explained with reference to FIGS. 6 to 10. An operation to change the posture of the holding portion 51 is performed in a state in which the embroidery frame 50 has been moved to a escape position shown in FIG. 2. The escape position is a position in which the posture of the holding portion 51 can be changed. In the present embodiment, the escape position is a position in which the holding portion 51 does not come into contact with the needle bar 6 and the presser foot 9 that is attached to the lower end portion of the presser bar 8, nor with other members that are provided on the sewing machine 1, when the operation is performed to change the posture of the holding portion 51. More specifically, the escape position is a position in which, when seen from the side of the needle bar 6 of the sewing machine 1 toward the side of the needle plate 21, an area that is inside an outer edge of the holding portion 51 does not overlap with the needle plate cover 22. In the escape position, in the state in which the embroidery frame 50 is mounted on the carriage 42, the needle plate cover 22 can be opened and closed. Therefore, it is possible to replace the inner shuttle and the lower thread bobbin. In specific terms, the escape position is a position when the carriage 42 has been moved to the leftmost side and to the frontmost side.

In the state in which the holding portion 51 is in the first posture shown in FIG. 6, the user may grasp the front end of the plate spring 551 and the rear end of the plate spring 552 with the user's fingers and pushes them upward. When this is done, the engagement between the engagement portion 517 and the latching portion 55 and the engagement between the engagement portion 518 and the latching portion 56 may be released. The user may move the holding portion 51 to the right while resisting an urging force of the spring 543. When this is done, as shown in FIG. 7, the insertion plate portions 527 and 528 may be pulled out of the recessed portions 540, and the holding portion 51 can rotate in the first direction around the shafts 549 and 550 (refer to FIG. 4). The user may end the operation of the plate springs 551 and 552, may rotate the holding portion 51 around the shafts 549 and 550 in the counterclockwise direction in a front view, and may cause the holding portion 51 to be in a tilted state with respect to the horizontal plane. After that, as shown in FIG. 8, the user may rotate the holding portion 51 in the second direction. As shown in FIG. 9, after the user may rotates the holding portion 51 by 180 degrees in the second direction, the user may rotate the holding portion 51 around the shafts 549 and 550 in the clockwise direction in a front view, and may return the holding portion 51 to its original horizontal state from the state in which the holding portion 51 is tilted with respect to the horizontal plane. After that, in the state in which the user grasps the front end of the plate spring 551 and the rear end of the plate spring 552 with the user's fingers and pushes them upward, the user may use the urging force of the spring 543 to move the holding portion 51 to the left. When this is done, the insertion plate portions 527 and 528 may be inserted into the recessed portions 540 such that the insertion plate portions 527 and 528 are arranged below the plate spring 552 and the plate spring 551, respectively. The user may end the operation on the plate springs 551 and 552. When this is done, as shown in FIG. 10, the front end of the plate spring 551 and the rear end of the plate spring 552 may move downward due to the urging force, and the engagement portions 517 and 518 may respectively engage with the latching portions 56 and 55. When the posture of the holding portion 51 of the embroidery frame 50 is changed from the second posture to the first posture, a similar operation may be performed. In the present embodiment, the sewing area set inside the holding portion 51 is in the substantially same position in both the first posture and the second posture. The sewing area is a substantially rectangular area on which a stitch may be formed and which is automatically set to be inside the frame-shaped holding portion, depending on the type of the embroidery frame. A center point of the sewing area is an origin point of the embroidery coordinate system.

Figure 11:
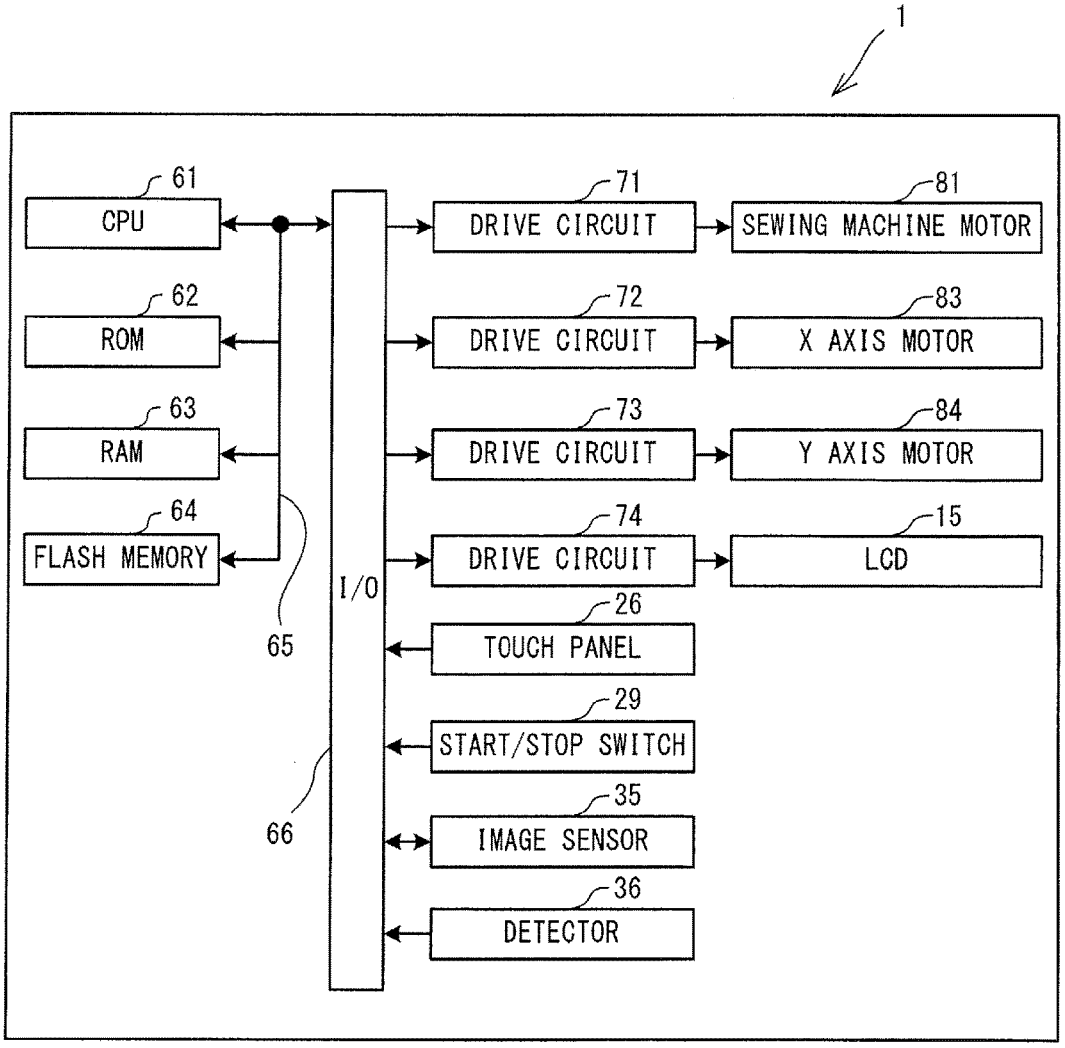
FIG. 11 is a block diagram showing an electrical configuration of the sewing machine.

The electrical configuration of the sewing machine 1 will be explained with reference to FIG. 11. As shown in FIG. 11, the sewing machine 1 includes the CPU 61 as well as a ROM 62, the RAM 63, a flash memory 64, and an input/output interface (I/O) 66, which are each connected to the CPU 61 by a bus 65.

The CPU 61 performs overall control of the sewing machine 1, and executes various calculations and processing relating to sewing, in accordance with various programs stored in the ROM 62. Although not shown in the drawings, the ROM 62 includes a plurality of storage areas, including a program storage area and a pattern storage area. The various programs to operate the sewing machine 1 are stored in the program storage area. The stored programs include, for example, a program that causes the sewing machine 1 to perform the pattern sewing processing, which will be explained below. Pattern data, which is used to perform sewing of various patterns, is stored in the pattern storage area. The various patterns include, for example, utility patterns and embroidery patterns.

Storage areas are provided in the RAM 63 as necessary, in order to store calculation results etc, of calculation processing by the CPU 61. The flash memory 64 stores various parameters etc., which are used for the sewing machine 1 to perform various processing. Drive circuits 71 to 74, the touch panel 26, the start/stop switch 29, the image sensor 35, and the detector 36 are connected to the I/O 66.

The sewing machine motor 81 is connected to the drive circuit 71. The drive circuit 71 may drive the sewing machine motor 81 in accordance with a control signal from the CPU 61. The needle bar up-and-down movement mechanism 34 may be driven via the drive shaft (not shown in the drawings) of the sewing machine 1 in accordance with the driving of the sewing machine motor 81, and the needle bar 6 may be thus moved up and down. The X axis motor 83 is connected to the drive circuit 72. The Y axis motor 84 is connected to the drive circuit 73. The drive circuits 72 and 73 may drive the X axis motor 83 and the Y axis motor 84, respectively, in accordance with a control signal from the CPU 61. The embroidery frame 50 may be moved in the left-right direction (the X axis direction) and in the front-rear direction (the Y axis direction) in accordance with the driving of the X axis motor 83 and the Y axis motor 84, by a movement amount that corresponds to the control signal. The drive circuit 74 may cause an image to be displayed on the LCD 15 by driving the LCD 15 in accordance with a control signal from the CPU 61.

A combination pattern, which is an embroidery pattern that can be sewn by the sewing machine 1 of the present embodiment, will be explained. The embroidery pattern is a pattern that is represented by a plurality of stitches. The sewing machine 1 of the present embodiment can sew a normal embroidery pattern, a bobbin work pattern, and the combination pattern, using the embroidery frame 50. The combination pattern is a pattern that is obtained by combining a normal embroidery pattern and a bobbin work pattern. The normal embroidery pattern is sewn using normal embroidery thread or sewing machine thread. The normal embroidery pattern is to be formed in a state in which a finish surface of the sewing workpiece 3 is arranged on the side of the needle bar 6. In other words, the finish surface of the normal embroidery pattern is the surface of the sewing workpiece 3 on which the normal embroidery pattern is to be formed, and is the top surface of the sewing workpiece 3. The bobbin work pattern is sewn using, as a lower thread, one of a thread and a string-like material of a thickness that is larger than an eye of the sewing needle 7. Hereinafter, it is assumed that the string-like material is used as the lower thread when sewing the bobbin work pattern. The string-like material is, for example, a decorative cord, wool yarn, a ribbon, or the like. Further, the upper thread that is used for sewing the bobbin work pattern may be a sewing machine thread that has a similar color to the color of the string-like material, or may be a transparent thread, for example. The bobbin work pattern is to be formed in a state in which the finish surface of the sewing workpiece 3 is arranged on the side of the needle plate 21. In other words, the finish surface of the bobbin work pattern is the bottom surface of the sewing workpiece 3. In this way, the finish surface, with respect to the needle bar 6, is different for the normal embroidery pattern and the bobbin work pattern. Therefore, when the combination pattern is sewn, in order to reverse the top and bottom surfaces of the sewing workpiece 3 during the sewing, the sewing machine 1 may notify the user to change the posture of the holding portion 51 of the embroidery frame 50 from the first posture to the second posture.

In the present embodiment, a plurality of sets of normal embroidery pattern data, a plurality of sets of bobbin work pattern data, and a plurality of sets of combination pattern data are prepared and are stored in the ROM 62. The user may choose a desired pattern from among patterns corresponding to the plurality of sets of pattern data stored in the ROM 62. The normal embroidery pattern data is pattern data used by the sewing machine 1 to perform sewing of the normal embroidery pattern. The bobbin work pattern data is pattern data used by the sewing machine 1 to perform sewing of the bobbin work pattern. The combination pattern data is pattern data used by the sewing machine 1 to perform sewing of the combination pattern that is a combination of the normal embroidery pattern and the bobbin work pattern. Each set of the pattern data includes at least coordinate data indicating needle drop points in order to move the embroidery frame 50, and data indicating a pattern number. The needle drop point is a point at which the sewing needle 7 (refer to FIG. 3) can pierce the sewing workpiece 3. In the present embodiment, the coordinate data indicating the needle drop points are represented by coordinates of the XY coordinate system (hereinafter referred to as the embroidery coordinate system) when the X axis motor 83 and the Y axis motor 84 move the embroidery frame 50. The bobbin work pattern data is data that takes into account the fact that the finish surface of the bobbin work pattern is the bottom surface of the sewing workpiece 3.

For the normal embroidery pattern, the bobbin work pattern, and the combination pattern, a center point of a minimum rectangle that encompasses the whole of the pattern is set as a center point of the pattern. In a default setting state of the sewing machine 1, the center point of the pattern is arranged such that the center point of the pattern matches the center point of the sewing area, and the pattern is sewn. The center point of the sewing area is set such that the center point of the sewing area matches the origin point of the embroidery coordinate system. As will be explained in more detail below, for the normal embroidery pattern, the bobbin work pattern, and the combination pattern, editing may be performed to change a sewing position etc.

The pattern number is a number that is used to identify the plurality of patterns. For example, it is assumed that pattern numbers 1 to 50 are assigned to the individual normal embroidery patterns, pattern numbers 51 to 70 are assigned to the individual bobbin work patterns, and pattern numbers 71 to 90 are assigned to the individual combination patterns. In this case, in a case where the user selects the desired pattern, the CPU 61 can identify the type of the selected pattern by referring to the pattern number assigned to the pattern.

Figure 12:
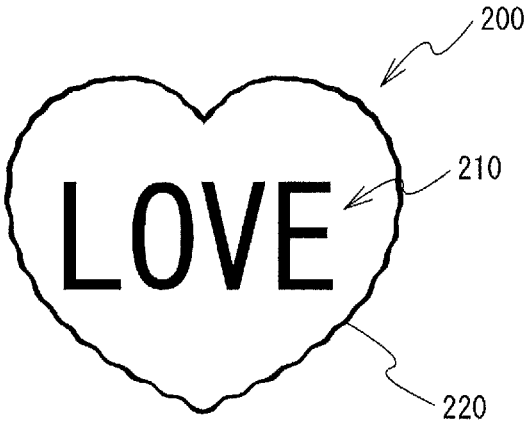
FIG. 12 is an explanatory diagram of a pattern.

A pattern 200 shown in FIG. 12 will be explained. The left-right direction and the up-down direction in FIG. 12 correspond to the X axis direction and the Y axis direction of the embroidery coordinate system, respectively. The pattern 200 is a combination pattern in which a normal embroidery pattern 210 and a bobbin work pattern 220 are combined. The normal embroidery pattern 210 is a pattern representing, in capital letters, the alphabetized word "LOVE." The bobbin work pattern 220 is a heart-shaped pattern and is arranged such that the bobbin work pattern 220 encircles the normal embroidery pattern 210. In this case, a center point of the normal embroidery pattern 210 and a center point of the bobbin work pattern 220 match each other. The normal embroidery pattern 210 may be formed on the sewing workpiece 3 using satin stitch, for example.

In a case where the sewing machine 1 sews the pattern 200 on the sewing workpiece 3, any one of the normal embroidery pattern 210 and the bobbin work pattern 220 may be sewn first. In the following explanation, it is assumed that the normal embroidery pattern 210 is sewn first and the bobbin work pattern 220 is sewn next.

The may user cause the holding portion 51 to hold the sewing workpiece 3 such that the finish surface of the sewing workpiece 3 is on the side of the first surface 57 (refer to FIG. 6) of the first member 511. The user may attach the embroidery frame 50 to the carriage 42 while the holding portion 51 is in the first posture (refer to FIG. 6). In this way, the finish surface of the sewing workpiece 3 may be on the side of the needle bar 6 of the sewing machine 1. The user may operate the start/stop switch 29 and may cause the sewing machine 1 to operate, and thus the normal embroidery pattern 210 may be sewn on the finish surface (the top surface) of the sewing workpiece 3. Next, the user may change the posture of the holding portion 51 from the first posture to the second posture (refer to FIG. 10), in order to sew the bobbin work pattern 220. In this way, the finish surface of the sewing workpiece 3 is on the side of the needle plate 21 of the sewing machine 1. The user may change the upper thread from the normal embroidery thread to the transparent thread or the like, and may replace the inner shuttle and the lower thread bobbin with a specialized bobbin work inner shuttle and a lower thread bobbin on which the string-like material is wound. After that, the user may operate the start/stop switch 29 and may cause the sewing machine 1 to operate, and thus the bobbin work pattern 220 may be sewn on the finish surface (the bottom surface) of the sewing workpiece 3.

In this way, even when the holding portion 51 is changed from the first posture to the second posture, the embroidery frame 50 is not removed from the carriage 42, as described above. Thus, the position of the frame holder 43 with respect to the carriage 42 does not change. Further, even if the posture of the holding portion 51 is changed from the first posture to the second posture, the sewing area is in the same position. Thus, there is no displacement between the position at which the normal embroidery pattern 210 is sewn and the position at which the bobbin work pattern 220 is sewn.

The pattern sewing processing according to the first embodiment will be explained with reference to FIG. 13. As an example, a case is explained in which the user selects the pattern 200 by a panel operation, and inputs a start instruction to start the pattern sewing processing. In a case where the CPU 61 detects the input of the instruction to start the pattern sewing processing, the CPU 61 reads, into the RAM 63, the program that is used to execute the pattern sewing processing and that is stored in the ROM 62 (refer to FIG. 11). The CPU 61 then executes each step of the processing, as explained below, in accordance with instructions included in the program. Before inputting the start instruction, the user may mount the embroidery frame 50, which is holding the sewing workpiece 3, on the carriage 42, such that the holding portion 51 is in the first posture.

Figure 13:
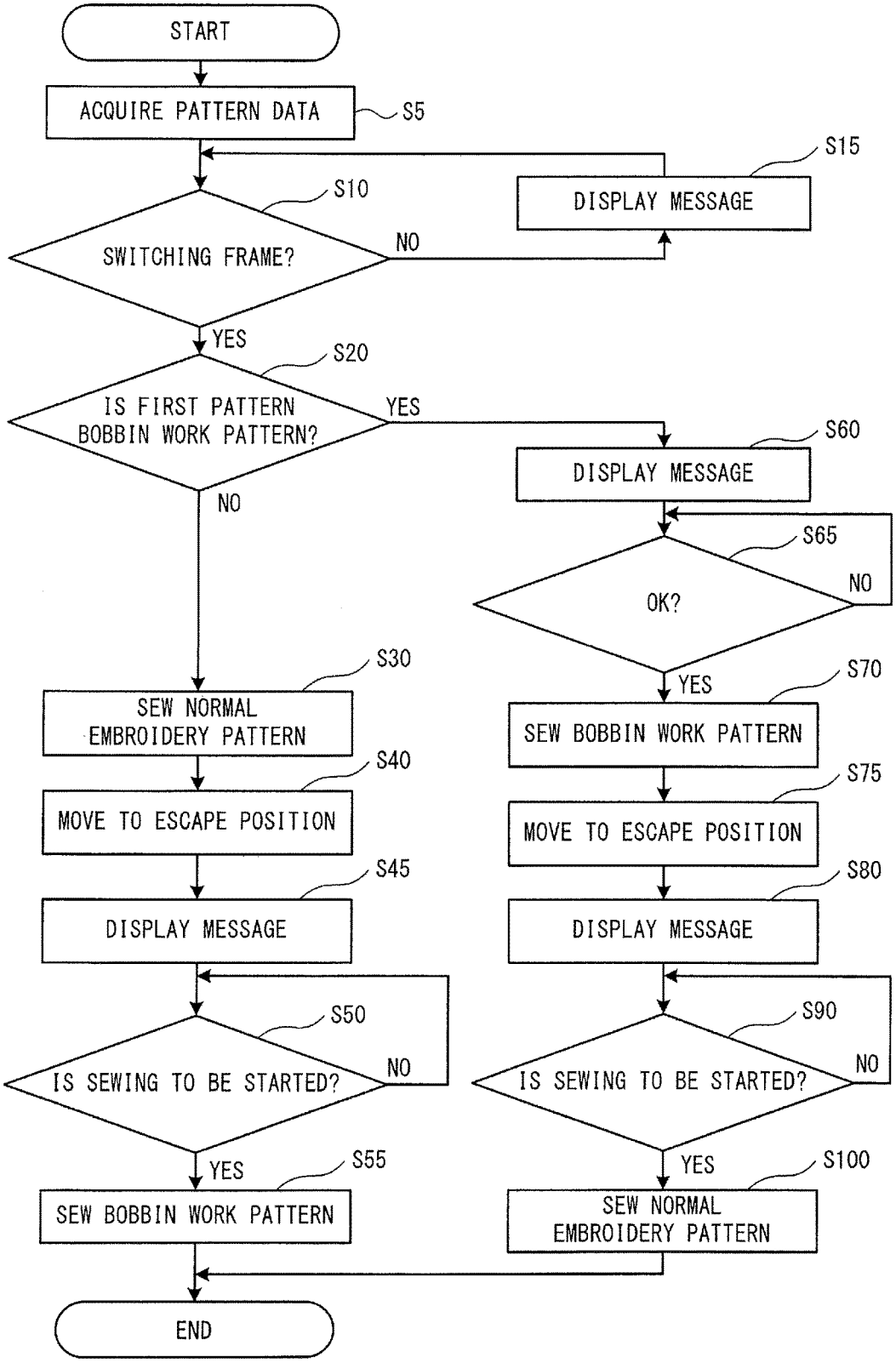
FIG. 13 is a flowchart of pattern sewing processing of a first embodiment.

As shown in FIG. 13, in the pattern sewing processing, the CPU 61 first acquires the pattern data of the pattern 200 that is selected at the start of the pattern sewing processing (step S5). More specifically, at the start of the pattern sewing processing, the CPU 61 acquires from the ROM 62 the combination pattern data that is used to sew the pattern 200 selected by the user, and stores the acquired combination pattern data in the RAM 63. At that time, the user may specify which of the normal embroidery pattern 210 and the bobbin work pattern 220 that are included in the pattern 200 is to be sewn first. A flag is set for the specified pattern and stored in the RAM 63. Based on a detection result from the detector 36, the CPU 61 determines whether the embroidery frame attached to the carriage 42 is the embroidery frame 50 (the switching frame) (step S10). In a case where the embroidery frame attached to the carriage 42 is not the embroidery frame 50 (no at step S10), the CPU 61 displays, on the LCD 15, a screen (not shown in the drawings) that includes a message prompting the user to mount the embroidery frame 50 on the carriage 42 (step S15). The CPU 61 then returns to the processing at step S10. The user may check the message displayed on the LCD 15 and may mount the embroidery frame 50 on the carriage 42.

In a case where the embroidery frame attached to the carriage 42 is the embroidery frame 50 (yes at step S10), the CPU 61 determines whether the first pattern, of the pattern 200, to be sewn first is the bobbin work pattern 220, based on the set flag (step S20). In a case where the first pattern is the normal embroidery pattern 210, and is not the bobbin work pattern 220 (no at step S20), the CPU 61 performs processing to sew the normal embroidery pattern 210 (step S30). The first pattern is sewn while the holding portion 51 is in the first posture. Specifically, the CPU 61 drives the X axis motor 83 and the Y axis motor 84 in accordance with the normal embroidery pattern data acquired at step S5 and moves the embroidery frame 50 using the movement mechanism 40. The CPU 61 drives the sewing machine motor 81 in concert with the movement of the embroidery frame 50, and moves the needle bar 6, to which the sewing needle 7 is attached, up and down. In this way, the sewing machine 1 forms the normal embroidery pattern 210 on the surface, of the sewing workpiece 3 held by the embroidery frame 50, on the side of the needle bar 6.

Next, the CPU 61 drives the X axis motor 83 and the Y axis motor 84 and causes the movement mechanism 40 to move the embroidery frame 50 to the escape position (refer to FIG. 2) (step S40). After that, the CPU 61 displays, on the LCD 15, a screen (not shown in the drawings) that includes a message prompting the user to change the posture of the holding portion 51 of the embroidery frame 50 from the first posture to the second posture (step S45). The user may check the message displayed on the LCD 15 and may change the posture of the holding portion 51 of the embroidery frame 50 from the first posture to the second posture. In addition, the user may open the needle plate cover 22 and may replace the inner shuttle and the lower thread bobbin with a specialized bobbin work pattern inner shuttle and a lower thread bobbin on which the string-like material is wound. The user may change the upper thread from the embroidery thread to the transparent thread or the like.

Based on whether an instruction has been input from the start/stop switch 29, the CPU 61 determines whether an instruction to start sewing has been acquired (step S50). While the instruction to start sewing is not acquired (no at step S50), the CPU 61 repeats the processing at step S50. In a case where the instruction to start sewing has been acquired (yes at step S50), the CPU 61 performs processing to sew the bobbin work pattern 220 (step S55). In this case, the bobbin work pattern 220 is sewn in a state in which the holding portion 51 is in the second posture. Specifically, the CPU 61 drives the X axis motor 83 and the Y axis motor 84 (refer to FIG. 11) in accordance with the bobbin work pattern data acquired at step S5, and causes the movement mechanism 40 to move the embroidery frame 50. The CPU 61 drives the sewing machine motor 81 in concert with the movement of the embroidery frame 50, and moves the needle bar 6, to which the sewing needle 7 is attached, up and down. In this way, the sewing machine 1 forms the bobbin work pattern 220 on the surface, of the sewing workpiece 3 held by the embroidery frame 50, on the side of the needle plate 21. In this manner, the normal embroidery pattern 210 and the bobbin work pattern 220 are formed on the finish surface of the sewing workpiece 3. When the sewing of the bobbin work pattern 220 is finished, the CPU 61 ends the pattern sewing processing.

Meanwhile, in a case where the first pattern is the bobbin work pattern 220 (yes at step S20), the CPU 61 displays, on the LCD 15, a screen (not shown in the drawings) that includes a message prompting the user to verify that the finish surface of the sewing workpiece 3 is on the side of the needle plate 21 (step S60). The user may check the message displayed on the LCD 15 and may check that the finish surface of the sewing workpiece 3 is on the side of the needle plate 21. The screen displayed on the LCD 15 includes an "OK" button. The CPU 61 determines whether a selection of the "OK" button by a panel operation has been detected (step S65). While the selection of the "OK" button is not detected (no at step S65), the CPU 61 repeats the processing at step S65. In a case where the selection of the "OK" button is detected (yes at step S65), the CPU 61 performs the processing to sew the bobbin work pattern 220 in the same manner as the processing at step S55 (step S70).

The CPU 61 moves the embroidery frame 50 to the escape position in a similar manner to the processing at step S40 (step S75). The CPU 61 displays, on the LCD 15, a screen (not shown in the drawings) that includes a message prompting the user to change the posture of the holding portion 51 of the embroidery frame 50 from the first posture to the second posture (step S80). The user may check the message displayed on the LCD 15, and may change the posture of the holding portion 51 of the embroidery frame 50 from the first posture to the second posture. The user may open the needle plate cover 22 and may replace the inner shuttle from the specialized bobbin work pattern inner shuttle to the normal inner shuttle. The user may also replace the lower thread bobbin with the lower thread bobbin on which the normal sewing machine thread is wound.

Based on whether or not the instruction has been input from the start/stop switch 29, the CPU 61 determines whether or not the instruction to start sewing has been acquired (step S90). While the instruction to start sewing is not acquired (no at step S90), the CPU 61 repeats the processing at step S90. In a case where the instruction to start sewing is acquired (yes at step S90), the CPU 61 performs the processing to sew the normal embroidery pattern 210, in a similar manner to the processing at step S30 (step S100). In this manner, the normal embroidery pattern 210 and the bobbin work pattern 220 are formed on the finish surface of the sewing workpiece 3. When the sewing of the normal embroidery pattern 210 is finished, the CPU 61 ends the pattern sewing processing.

The sewing machine 1 of the present embodiment sews the first pattern that is one of the normal embroidery pattern 210 and the bobbin work pattern 220 that are included in the selected pattern 200 (step S30, step S70), and after that, automatically moves the embroidery frame 50 to the escape position (step S40, step S75). The escape position is a position in which the posture of the holding portion 51 can be changed. Thus, the user can easily switch the posture of the holding portion 51 of the embroidery frame 50 before the second pattern is sewn.

The escape position is, specifically, a position in which the holding portion 51 does not come into contact with the needle bar 6 and the presser foot 9, and other members when the operation to change the posture of the holding portion 51 is performed. Therefore, the user can more easily change the posture of the holding portion 51 of the embroidery frame 50 when the embroidery frame 50 is in the escape position. More specifically, the escape position is a position in which, when seen from above the sewing machine 1, the area inside the outer edge of the holding portion 51 does not overlap with the needle plate cover 22. Therefore, the user can open the needle plate cover 22 and easily replace the inner shuttle and the lower thread housed in the shuttle. In the present embodiment, specifically, the escape position is the position in which the carriage 42 is moved to the leftmost side and to the frontmost side. Thus, the embroidery frame 50 is separated from the members of the sewing machine 1, such as the needle bar 6, the presser foot 9, etc., and from the needle plate cover 22. Therefore, the user can easily perform operations to change the posture of the holding portion 51 and to replace the inner shuttle and the lower thread housed in the shuttle.

After the embroidery frame 50 has been moved to the escape position, the CPU 61 displays, on the LCD 15, the screen that includes the message prompting the user to change the posture of the holding portion 51 of the embroidery frame 50 from the first posture to the second posture (step S45, step S80). Therefore, by checking the message displayed on the LCD 15, the user can easily know that it is necessary to change the posture of the holding portion 51. As a result, the user can change the posture of the holding portion 51 without making any mistake in the operation.

One of the plurality of types of embroidery frames can be mounted on and removed from the carriage 42 of the movement mechanism 40. In a case where, based on the detection result by the detector 36 provided on the carriage 42, the CPU 61 determines that the type of the embroidery frame attached to the carriage 42 is the embroidery frame 50 (yes at step S10), the CPU 61 moves the embroidery frame 50 to the escape position (step S40, step S75). Therefore, in a case where the embroidery frame 50, which is the switching frame, is mounted on the movement mechanism 40, the sewing machine 1 can automatically move the embroidery frame 50 to the escape position after sewing the first pattern.

The sewing machine 1 can easily sew the normal embroidery pattern and the bobbin work pattern in combination with each other on the same finish surface of the sewing workpiece 3. Further, in the present embodiment, even when the posture of the holding portion 51 is changed from the first posture to the second posture, the sewing area is in the same position. Thus, it is possible to perform sewing without any displacement between the position at which the normal embroidery pattern is sewn and the position at which the bobbin work pattern is sewn.

After the pattern sewing processing has been started, in a case where the first pattern is the bobbin work pattern (yes at step S20), the CPU 61 displays, on the LCD 15, the screen that includes the message prompting the user to check that the finish surface of the sewing workpiece 3 is on the side of the needle plate 21 (step S60). The user can therefore check the message displayed on the LCD 15 before the bobbin work pattern is sewn as the first pattern, and can check whether the finish surface of the sewing workpiece 3 is on the side of the needle plate 21. It is therefore possible to inhibit the bobbin work pattern from being sewn on the surface of the sewing workpiece 3 that is not intended by the user.

Pattern sewing processing according to the second embodiment will be explained with reference to FIG. 14. In the second embodiment, after the pattern sewing processing is started and the first pattern has been sewn, an image of the sewn first pattern is captured by the image sensor 35. Then, the captured image of the pattern is displayed on the LCD 15 along with a marker indicating the center point of the second pattern, and an instruction for editing the second pattern is received.

The pattern sewing processing of the second embodiment is substantially the same as that of the first embodiment, and therefore the same step numbers are assigned to the same processing steps as those shown in the flowchart in FIG. 13 and an explanation thereof is omitted here. The explanation below will mainly explain processing content that is different. As an example, a case will be explained in which the user selects the pattern 200 by a panel operation and inputs the start instruction to start the pattern sewing processing.

Figure 14:
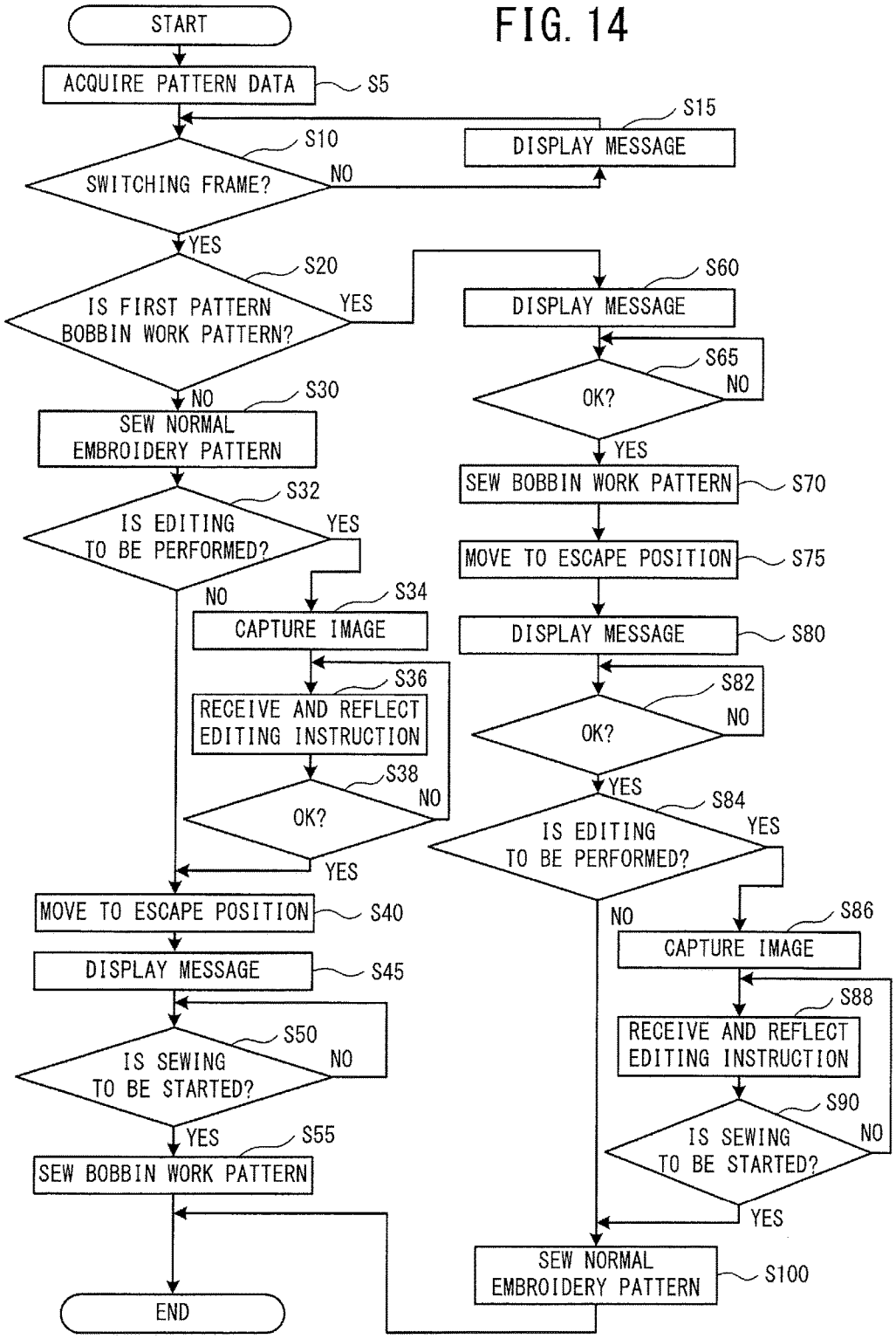
FIG. 14 is a flowchart of pattern sewing processing of a second embodiment.

As shown in FIG. 14, the content of the processing by the CPU 61 from acquisition of the pattern data of the pattern 200 that is selected at the start of the pattern sewing processing to determination whether the first pattern is the bobbin work pattern 220 (step S5 to step S20) is the same as that of the first embodiment. In a case where the first pattern is the normal embroidery pattern 210 and not the bobbin work pattern 220 (no at step S20), the CPU 61 performs the processing to sew the normal embroidery pattern 210 (step S30), in a similar manner to the processing of the first embodiment. After that, the CPU 61 determines whether editing is to be performed on the bobbin work pattern 220 that is the second pattern (step S32). More specifically, the CPU 61 displays, on the LCD 15, a screen (not shown in the drawings) that includes a message prompting the user to select whether or not to change the position of the bobbin work pattern 220 that is the second pattern, a "YES" button, and a "NO" button. Then, the CPU 61 determines whether selection of one of the "YES" button and the "NO" button by a panel operation has been detected. In a case where the selection of the "NO" button has been detected, the CPU 61 determines that editing of the bobbin work pattern 220 is not to be performed (no at step S32). In a similar manner to the processing of the first embodiment, the CPU 61 moves the embroidery frame 50 to the escape position and performs the processing up to the sewing of the bobbin work pattern 220 (step S40 to step S55). In a case where the sewing of the bobbin work pattern 220 is finished, the CPU 61 ends the pattern sewing processing.

Figure 15:
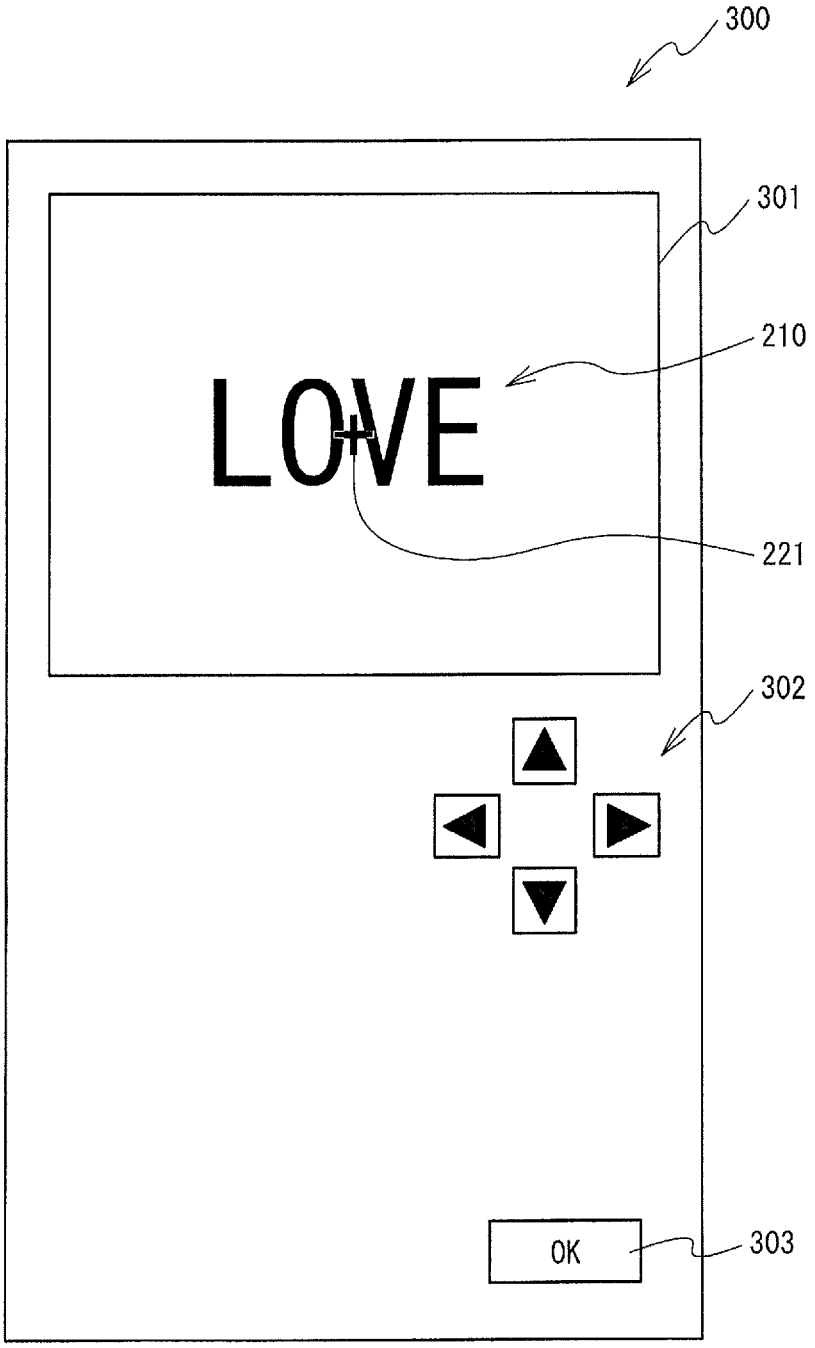
FIG. 15 is an explanatory diagram of a screen that is displayed on a liquid crystal display (LCD).

In a case where the selection of the "YES" button has been detected at step S32, the CPU 61 determines that editing of the bobbin work pattern 220 is to be performed (yes at step S32). In a state in which the embroidery frame 50 is in the initial position, the CPU 61 causes the image sensor 35 to capture an image of the sewn normal embroidery pattern 210, and acquires image data output from the image sensor 35 into a predetermined storage area of the RAM 63 (step S34). In the present embodiment, an image capture area of the image sensor 35 is a rectangular area centering on the needle hole. As shown in FIG. 15, the CPU 61 displays, on the LCD 15, a screen 300 that includes an image (hereinafter referred to as a "captured image") represented by the acquired image data. The CPU 61 receives an instruction for editing the bobbin work pattern 220 by a panel operation. The CPU 61 causes the received instruction to be reflected in the bobbin work pattern data and in display content in an image display field 301 of the screen 300 (step S36).

The screen 300 includes, for example, the image display field 301, a movement key cluster 302 that includes direction keys of four directions, and an "OK" button 303. The image display field 301 is displayed at the top of the screen 300. The movement key cluster 302 is displayed to the lower right of the image display field 301 on the screen 300. The "OK" button 303 is displayed on the bottom right of the screen 300. A center point of the image display field 301 corresponds to the origin point of the embroidery coordinate system. The left-right direction and the up-down direction of the image display field 301 respectively correspond to the X axis direction and the Y axis direction of the embroidery coordinate system. On the image display field 301, the first pattern that has been sewn (the normal embroidery pattern 210 in the example shown in FIG. 15) is displayed along with a marker 221 that indicates the center point of the second pattern (the bobbin work pattern 220 in the example shown in FIG. 15). The marker 221 is, for example, a cross shape as shown in FIG. 15, and the intersection point of the cross indicates the center point of the second pattern. When the captured image is initially displayed, the captured image is displayed such that the center point of the first pattern (the normal embroidery pattern 210) included in the captured image is positioned on the center point of the image display field 301. Further, the marker 221 is displayed such that the intersection point of the cross of the marker 221 is positioned on the center point of the image display field 301. In other words, the captured image and the marker 221 are displayed such that the center point of the first pattern and the intersection point of the cross of the marker 221 overlap with each other.

The user can move the second pattern from the initial position by a desired movement amount, by performing a panel operation of one of the four direction keys included in the movement key cluster 302. In a case where the panel operation of one of the four direction keys is performed, the marker 221 displayed on the image display field 301 is moved by an operated movement amount in the direction indicated by the direction key used in the panel operation. The user can change the position of the second pattern with respect to the first pattern while checking the positions of the marker 221 and the image of the first pattern that are displayed on the image display field 301. Further, the CPU 61 modifies coordinate values indicating the needle drop points of the pattern data of the second pattern (the bobbin work pattern data) by the movement amount instructed by the panel operation of the direction key, and stores the modified coordinate values in the RAM 63. In this way, the pattern data is modified such that the position of the second pattern is moved by the movement amount instructed by the panel operation of the direction key.

The CPU 61 determines whether a selection of the "OK" button by a panel operation has been detected (step S38). In a case where the selection of the "OK" button has not been detected (no at step S38), the CPU 61 returns to the processing at step S36. In a case where the selection of the "OK" button has been detected (yes at step S38), in a similar manner to the processing of the first embodiment, the CPU 61 moves the embroidery frame 50 to the escape position and performs the processing up to the sewing of the bobbin work pattern 220 that is the second pattern (step S40 to step S55). The sewing of the bobbin work pattern 220 is performed in accordance with the bobbin work pattern data modified at step S36. When the sewing of the bobbin work pattern 220 is finished, the CPU 61 ends the pattern sewing processing.

Meanwhile, in a case where the first pattern is the bobbin work pattern 220 (yes at step S20), in a similar manner to the processing of the first embodiment, the CPU 61 displays, on the LCD 15, the screen that includes the message prompting the user to check that the finish surface of the sewing workpiece 3 is on the side of the needle plate 21 (step S60). Then, the CPU 61 performs the processing up to the display of the screen on the LCD 15 that includes the message prompting the user to change the posture of the holding portion 51 (step S65 to step S80). In the second embodiment, the screen displayed on the LCD 15 at step S80 includes the "OK" button. The CPU 61 determines whether a selection of the "OK" button by a panel operation has been detected (step S82). While the selection of the "OK" button is not detected (no at step S82), the CPU 61 repeats the processing at step S82. In a case where the selection of the "OK" button is detected (yes at step S82), the CPU 61 determines whether or not editing is to be performed on the normal embroidery pattern 210 that is the second pattern (step S84). More specifically, the CPU 61 displays, on the LCD 15, a screen (not shown in the drawings) that includes a message prompting the user to select whether or not to change the position of the normal embroidery pattern 210 that is the second pattern, the "YES" button and the "NO" button. Then, the CPU 61 determines whether selection of one of the "YES" button, and the "NO" button by a panel operation has been detected. In a case where the selection of the "NO" button has been detected, the CPU 61 determines that editing of the normal embroidery pattern 210 is not to be performed (no at step S84). In a similar manner to the processing of the first embodiment, the CPU 61 performs the processing to sew the normal embroidery pattern 210 of the pattern 200 that is selected at the start of the pattern sewing processing (step S100). When the sewing of the normal embroidery pattern 210 is finished, the CPU 61 ends the pattern sewing processing.

In a case where the selection of the "YES" button is detected at step S84, the CPU 61 determines that editing of the normal embroidery pattern 210 is to be performed (yes at step S84). In a similar manner to the processing at step S34, the CPU 61 causes the image sensor 35 to capture an image of the sewn bobbin work pattern 220, and acquires image data output from the image sensor 35 into a predetermined storage area of the RAM 63 (step S86). In a similar manner to the processing at step S36, the CPU 61 receives an instruction for editing the normal embroidery pattern 210 by a panel operation. The CPU 61 causes the received instruction to be reflected in the normal embroidery pattern data and in display content in the image display field 301 of the screen 300 (step S88).

Based on whether the selection of the "OK" button by the panel operation has been detected, the CPU 61 determines whether the instruction to start sewing has been acquired (step S90). In a case where the instruction to start sewing has not been acquired (no at step S90), the CPU 61 returns to the processing at step S88. In a case where the instruction to start sewing has been acquired (yes at step S90), in a similar manner to the processing of the first embodiment, the CPU 61 performs the processing to sew the normal embroidery pattern 210 that is the second pattern (step S100). The sewing of the normal embroidery pattern 210 is performed in accordance with the normal embroidery pattern data modified at step S88. When the sewing of the normal embroidery pattern 210 is finished, the CPU 61 ends the pattern sewing processing.

The sewing machine 1 of the present embodiment can capture the image of the first pattern using the image sensor 35 (step S34, step S86) and display, on the LCD 15, the screen 300 that includes the captured image. Further, the sewing machine 1 can receive the instruction by the panel operation to edit (change the position of) the second pattern (step S36, step S88) and can modify the pattern data of the second pattern based on the received instruction. The sewing machine 1 can sew the second pattern based on the modified pattern data (step S55, step S 100). The user can therefore easily arrange the second pattern in the desired position with respect to the first pattern while viewing the captured image of the first pattern that is displayed on the LCD 15, and user convenience can be improved.

The sewing machine of the present disclosure is not limited to the above-described embodiments and various modifications may be made without departing from the spirit and scope of the present disclosure. For example, one of the following modifications (A) to (K) may be made as appropriate.

(A) The structure of the sewing machine 1 may be changed as appropriate. The number of needle bars of the sewing machine 1 may be one or more. It is sufficient that at least one type of the embroidery frame can be mounted on the sewing machine 1. The sewing machine 1 need not necessarily be provided with the detector 36. In that case, the processing at steps S10 and S15 of the pattern sewing processing may be omitted.

(B) The structure of the holding portion 51 may be changed as appropriate. The holding portion 51 may be asymmetrical and not necessarily symmetrical with respect to the vertical plane that passes through the central line M. The holding portion 51 need not necessarily be configured such that the sewing workpiece is arranged on the horizontal plane that passes through the central line M. The holding portion 51 may hold the sewing workpiece using the second member 512 only, using magnets, adhesive, a surface fastener, etc. The positions of the pivot portions 515 and 516 with respect to the holding portion 51 may be changed as appropriate. The horizontal surface shape of the holding portion 51 may be changed as appropriate and may be a circular frame shape, an elliptical frame shape, or the like. The number and the arrangement of the magnets of the holding portion 51 may be changed as appropriate. A magnet may be arranged on the first member 511 and a magnetic substance (a metal plate) may be arranged on the second member 512, and the magnetic force may be caused to operate in the direction of closing of the first member 511 and the second member 512.

(C) The structure of the switching portion 53 may be changed as appropriate. The switching portion 53 may be configured such that the switching of the posture of the holding portion 51 causes the position of the sewing area to be different between the first posture and the second posture. In this case, it is preferable that the sewing machine 1 be able to perform processing to change or set the sewing area in accordance with the posture of the holding portion 51. The structure of the engagement portions 517 and 518 may be changed as appropriate. The support portion 536 may be formed in a clip shape, for example, and the support portion 536 may clamp the insertion plate portions 527 and 528 when the holding portion 51 is in any one of the first posture and the second posture.

(D) The pattern data of the various patterns may be stored in a storage device (the flash memory 64, for example) other than the ROM 62 of the sewing machine 1. In addition, in a case where the sewing machine 1 is configured to be connected to a medium, such as a memory card, the sewing machine 1 may acquire pattern data stored in the medium and may store the acquired pattern data in the storage device (the flash memory 64, for example) of the sewing machine 1. In a case where the sewing machine 1 is configured to be connected an external device by a wireless or wired connection, the sewing machine 1 may acquire pattern data stored in the external device and store the acquired pattern data in the storage device.

(E) The type and the arrangement of the image sensor 35 may be changed as appropriate. For example, the image sensor 35 may be a device that can capture an image and output image data of the image, such as a CCD camera or the like. In addition, the capture area of the image sensor 35 may be smaller than the sewing area of the embroidery frame 50. In this case, the whole of the sewing area may be divided into a plurality of blocks and processing may be performed to move the embroidery frame 50 sequentially to a position corresponding to each of the blocks and capture an image of the pattern.

(F) The combination pattern, which is a combination of the normal embroidery pattern and the bobbin work pattern, need not necessarily be prepared in advance. The normal embroidery pattern may be selected at the start of the pattern sewing processing, the normal embroidery pattern may be sewn, and then the bobbin work pattern may be selected and sewn. The bobbin work pattern may be selected at the start of the pattern sewing processing, the bobbin work pattern may be sewn, and then the normal embroidery pattern may be selected and sewn. The pattern that is sewn in the first posture and the pattern that is sewn in the second posture may both be the normal embroidery pattern or may both be the bobbin work pattern. The CPU 61 may acquire pattern data of the pattern to be sewn in the first posture and pattern data of the pattern to be sewn in the second posture at different times.

(G) In the pattern sewing processing, the determination need not necessarily be made as to whether the first pattern is the bobbin work pattern. In this case, in the pattern sewing processing, one of the normal embroidery pattern and the bobbin work pattern may be sewn first, for example.

(H) A speaker may be provided in the sewing machine 1, and at at least one of steps S15, S45, S60, and S80 of the pattern sewing processing, notification of the message may be performed by audio. The processing at at least one of steps S15, S45, S60, and S80 may be omitted.

(J) In addition to the movement key cluster 302, a rotation key, a zoom key, etc., for example, may be provided on the screen 300 that is displayed at steps S36 and S88 of the second embodiment. The rotation key is a key that is used to rotate the second pattern from an initial position by a desired angle. The zoom key is a key that is used to expand or contract the size of the second pattern from the size of an initial state. The sewing machine 1 may receive the instruction to edit the second pattern via these keys that are used to edit the second pattern, the editing including at least the change of the position of the second pattern.

(K) The pattern sewing processing may be executed by an electronic device (an ASIC, for example) other than the CPU 61. The pattern sewing processing maybe executed by a plurality of electronic devices (namely, a plurality of CPUs) by distributed processing.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A sewing machine comprising:

a sewing portion that is configured to perform sewing on a sewing workpiece, the sewing portion including a needle bar and a needle plate, the needle plate including a lid member configured to cover an upper side of a shuttle housing a lower thread, and the lid member being configured to open and close;

a switching frame that is configured to hold the sewing workpiece, the switching frame including a holding portion, a base portion, and a switching portion, the holding portion being configured to hold the sewing workpiece, the base portion being configured to support the holding portion, the switching portion including a connecting portion, and the connecting portion rotatably connecting the holding portion to the base portion;

a movement mechanism that is configured to move the switching frame that is mounted thereon, the needle bar, the switching frame mounted on the movement mechanism, and the needle plate being arranged in this order in a particular direction, the switching portion being configured to be capable of switching a posture of the holding portion between a first posture and a second posture in a state in which the base portion is mounted on the movement mechanism, the holding portion including a first surface and a second surface, the second surface being on a side opposite to the first surface of the holding portion, the holding portion being configured such that, in a state in which the holding portion is in the first posture, the first surface is closer to the needle bar than the second surface in the particular direction and the second surface is closer to the needle plate than the first surface in the particular direction, and the holding portion being configured such that, in a state in which the holding portion is in the second posture, the second surface is closer to the needle bar than the first surface in the particular direction and the first surface is closer to the needle plate than the second service in the particular direction;

a processor; and a memory configured to store computer-readable instructions, wherein the computer-readable instructions, when executed by the processor, cause the sewing machine to perform processes comprising:

acquiring first pattern data used to sew a first pattern, the first pattern being a pattern to be sewn in the state in which the holding portion is in the first posture;

acquiring second pattern data used to sew a second pattern, the second pattern being a pattern to be sewn after the first pattern is sewn;

causing the movement mechanism to move the switching frame and causing the sewing portion to sew the first pattern on the sewing workpiece, based on the acquired first pattern data;

causing the movement mechanism to move the switching frame to an escape position after the first pattern is sewn, the escape position being a position in which the posture of the holding portion is switchable from the first posture to the second posture, and the escape position being a position in which an area inside an outer edge of the holding portion does not overlap with the lid member in the particular direction; and causing the movement mechanism to move the switching frame and causing the sewing portion to sew the second pattern on the sewing workpiece, based on the acquired second pattern data, after the movement mechanism moves the switching frame to the escape position.

2. The sewing machine according to claim 1, further comprising:

a presser foot that is configured to press the sewing workpiece;

wherein the escape position is a position in which the holding portion does not come into contact with the needle bar and the presser foot when the posture of the holding portion is switched from the first posture to the second posture.

3. The sewing machine according to claim 1, further comprising:

a first notification portion that is configured to perform notification of at least information relating to sewing, wherein the computer-readable instructions, when executed by the processor, further cause the sewing machine to perform a process comprising:

causing the first notification portion to perform notification of a message after the movement mechanism moves the switching frame to the escape position, the message being a message that prompts switching of the posture of the holding portion from the first posture to the second posture.

4. The sewing machine according to claim 1, further comprising:

an imaging portion that is configured to capture an image; and a display portion that is configured to display an image;

wherein the computer-readable instructions, when executed by the processor, further cause the sewing machine to perform processes comprising:

causing the imaging portion to capture, after the first pattern is sewn on the sewing workpiece, an image of the sewn first pattern;

causing the display portion to display a pattern image, the pattern image being an image that includes the first pattern captured by the imaging portion;

receiving an instruction to edit the second pattern, the instruction including at least changing a position of the second pattern with respect to the first pattern that is included in the pattern image displayed on the display portion; and modifying the second pattern data based on the received instruction, and the causing the movement mechanism to move the switching frame and the causing the sewing portion to sew the second pattern include causing the movement mechanism to move the switching frame and causing the sewing portion to sew the second pattern on the sewing workpiece, based on the modified second pattern data.

5. The sewing machine according to claim 1, further comprising:

a detection portion that is configured to detect a type of an embroidery frame mounted on the movement mechanism;

wherein the movement mechanism is configured such that any one of a plurality of types of embroidery frames is mountable on the movement mechanism, the plurality of the types of embroidery frames including the switching frame, and the causing the movement mechanism to move the switching frame to the escape position includes causing the movement mechanism to move the switching frame to the escape position in response to detecting the switching frame by the detection portion.

6. The sewing machine according to claim 1, wherein one of the first pattern and the second pattern is sewn using, as a lower thread, one of a thread and a string-like material having a thickness that is larger than an eye of a sewing needle, the sewing needle being configured to removably attached to the needle bar.

7. The sewing machine according to claim 6, further comprising:

a second notification portion that is configured to perform notification of information;

wherein the computer-readable instructions, when executed by the processor, further cause the sewing machine to perform processes comprising:

determining whether the first pattern is a pattern to be sewn using one of the thread and the string-like material; and causing the second notification portion to perform notification of a message in response to determining that the first pattern is the pattern to be sewn using one of the thread and the string-like material, the message being a message prompting the second surface to be set as a surface on a side, of the sewing workpiece, on which the first pattern is to be formed.

* * * * *